US007328800B2

(12) United States Patent
Koike

(10) Patent No.: US 7,328,800 B2
(45) Date of Patent: Feb. 12, 2008

(54) CUSHIONING MATERIAL FOR PACKAGING AND PACKAGING MATTER

(75) Inventor: Motomu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 484 days.

(21) Appl. No.: 10/476,285

(22) PCT Filed: Aug. 26, 2002

(86) PCT No.: PCT/JP02/08585

§ 371 (c)(1),
(2), (4) Date: Oct. 29, 2003

(87) PCT Pub. No.: WO03/018429

PCT Pub. Date: Mar. 6, 2003

(65) Prior Publication Data

US 2004/0094448 A1 May 20, 2004

(30) Foreign Application Priority Data

Aug. 24, 2001 (JP) ..... 2001-254851

(51) Int. Cl.
*B65D 81/02* (2006.01)

(52) U.S. Cl. ..... 206/521; 206/588; 206/592

(58) Field of Classification Search ..... 206/320, 206/521, 588, 591, 592, 701, 723
See application file for complete search history.

(56) References Cited

U.S. PATENT DOCUMENTS

| | | | | |
|---|---|---|---|---|
| 1,585,682 | A * | 5/1926 | Oppenheim | 206/521 |
| 2,778,487 | A | 1/1957 | Raeburn | |
| 3,759,720 | A | 9/1973 | Young | |
| 4,146,128 | A | 3/1979 | Hogg et al. | |
| 4,739,353 | A | 4/1988 | Heuer et al. | |
| 5,469,692 | A | 11/1995 | Xanthopoulos | |
| 5,706,951 | A * | 1/1998 | Oinuma et al. | 206/710 |
| 6,105,765 | A | 8/2000 | Chu | |
| 6,405,873 | B2 * | 6/2002 | Koike | 206/592 |
| 6,877,608 | B2 * | 4/2005 | Koike | 206/592 |

FOREIGN PATENT DOCUMENTS

| | | |
|---|---|---|
| FR | 2 306 140 | 10/1976 |
| GB | 268964 | 4/1927 |
| JP | U 62-6273 | 1/1987 |

(Continued)

*Primary Examiner*—David T. Fidei
(74) *Attorney, Agent, or Firm*—Oliff & Berridge, PLC

(57) ABSTRACT

The invention provides a cushioning material for packaging that is suitable for packaging an electronic apparatus, an optical apparatus or an electronic apparatus having an optical system mounted therein, and a package that uses the cushioning material for packaging. In the invention, a lower spacer formed of corrugated cardboard, a lower pad, a projector as an article to be packaged that is wrapped in an anti-static bag having electrical conductivity, an upper pad and an upper spacer formed of a corrugated cardboard can be stacked inside a corrugated cardboard box. The upper and lower pads are, respectively, provided with a plurality of upper pad side hollow convex portions and a plurality of lower pad side hollow convex portions protruding in such a fashion as to encompass an accommodation space for the projector. Upper and lower side reinforcing plate portions of the upper and lower spacers, respectively, enter deep into these convex portions.

9 Claims, 21 Drawing Sheets

FOREIGN PATENT DOCUMENTS

| | | | |
|---|---|---|---|
| JP | U 5-7662 | | 2/1993 |
| JP | U-05-007662 | | 2/1993 |
| JP | U 5-46780 | | 6/1993 |
| JP | A 6-72430 | | 3/1994 |
| JP | A-06-072430 | | 3/1994 |
| JP | 6-1335 | * | 6/1994 |
| JP | A 8-276962 | | 10/1996 |
| JP | U 3061976 | | 6/1999 |
| JP | A 2000-33972 | | 2/2000 |
| JP | A-2000-033972 | | 2/2000 |
| JP | A 2000-53123 | | 2/2000 |
| JP | A 2000-153879 | | 6/2000 |
| JP | A-2000-153879 | | 6/2000 |

* cited by examiner

CUSHIONING MATERIAL FOR PACKAGING AND PACKAGING MATTER

BACKGROUND OF THE INVENTION

1. Field of Invention

This invention relates to a cushioning material for packaging that is suitable for packaging an electronic apparatus, an optical apparatus or an electronic apparatus having an optical system mounted therein, and a package using this cushioning material for packaging.

2. Description of Related Art

An electronic apparatus having an optical system mounted therein, such as a projector, must be protected from being damaged by impact from the outside during transportation while the apparatus is packaged into a corrugated cardboard box. For example, a cushioning material for packaging that has an upper pad 10 and a lower pad 20 as shown in FIGS. 21 and 22, has been used in the past. A lower stiffening plate 3 formed of a corrugated cardboard, a lower pad 20, a projector 50 as an article to be packaged (or an optical engine mounted in the projector) that is wrapped by an anti-static bag 500, an upper pad 10 and an upper stiffening plate 4 formed of a corrugated cardboard are stacked and accommodated in this order into a corrugated cardboard box 2 (discrete box). Here, both upper and lower pads 10 and 20 are formed of pulp mold or the like. A plurality of upper pad side hollow convex portions 15 and a plurality of lower pad side hollow convex portions 25 protrude respectively from these upper and lower pads 10 and 20 in such a fashion as to encompass an accommodation space 21 of the projector 50. Therefore, the projector 50 is encompassed by the upper pad side convex portions 15 and the lower pad side hollow convex portions 25 between the upper pad 10 and the lower pad 20 and is protected from vibration during transportation.

In some cases, the lower stiffening plate 3 formed of a corrugated cardboard, the lower pad 20, the projector 50 as the article to be packaged, the upper pad 10 and an accessory accommodation box 6 have been put in this order into the corrugated cardboard box 2 as shown in FIG. 23. In this case, too, the projector 50 is encompassed by the upper pad side hollow convex portion 15 and the lower pad side hollow convex portion 25 between the upper pad 10 and the lower pad 20 and is protected from vibration during transportation.

Furthermore, the lower stiffening plate 3 formed of a corrugated cardboard, the lower pad 20, the projector 50 as the article to be packaged that is wrapped by the anti-static bag 500 and the accessory accommodation box 6 have been put and accommodated in the past in this order into the corrugated cardboard box 2 as shown in FIGS. 24 and 25.

In such packaging structures, both the upper and lower pads 10 and 20 have been formed of pulp mold or the like in the past. The upper and lower pads 10 and 20 formed of the pulp mold are broken when impact is imparted to the package, and thus absorb the impact.

The corrugated cardboard box 2 that packages the projector 50 is sometimes dropped accidentally during transportation and a large impact is applied at this time to the projector 50 inside the corrugated cardboard box 2. Nonetheless, the cushioning materials according to the prior art sometimes fail to reliably protect the projector 50, and further improvement has been desired.

An instruction manual of the projector 50 written in principal languages is packaged together with the projector 50. When the projector 50 is exported to countries where languages other than the principal languages described above are used, an instruction manual written in specific languages must be inserted in place of the original instruction manual. In the packaging structure shown in FIG. 24, however, it is necessary to unpack the package and to take out the instruction manual from the accessory accommodation box 6 for replacement after the projector is completely packaged for export procedures or the like, and this operation is very troublesome.

SUMMARY OF THE INVENTION

In view of the problems described above, the invention aims at providing a cushioning material for packaging that is suitable for packaging an electronic apparatus, an optical apparatus or an electronic apparatus having an optical system mounted therein, and a package using this cushioning material for packaging.

To solve the problems, the invention uses the following construction for both types of a cushioning material for packaging that uses both upper and lower pads as pads and a cushioning material for packaging that uses only the lower pad but does not use the upper pad.

First, in a cushioning material for packaging having upper and lower pads, respectively having upper pad side hollow convex portions and lower pad side hollow convex portions protruding in such a fashion as to encompass an accommodation space for an article to be packaged, the cushioning material for packaging of the first type that uses both upper and lower pads can further include an upper spacer having upper side reinforcing plate portions entering the depth of the upper pad side hollow convex portions when the upper spacer is put over the upper pad.

In a cushioning material for packaging having upper and lower pads, respectively having upper pad side hollow convex portions and lower pad side hollow convex portions protruding in such a fashion as to encompass an accommodation space for an article to be packaged, the cushioning material for packaging can further include a lower spacer having lower side reinforcing plate portions entering the depth of the lower pad side hollow convex portions when the lower spacer is put under the lower pad.

In a cushioning material for packaging, including an upper pad, and a lower pad respectively having upper pad side hollow convex portions and lower pad side hollow convex portions protruding in such a fashion as to encompass an accommodation space for an article to be packaged, the cushioning material for packaging can further include a lower spacer having lower side reinforcing plate portions entering the depth of the lower pad side hollow convex portions when the lower spacer is put under the lower pad, and an upper spacer having upper side reinforcing plate portions entering the depth of the upper pad side hollow convex portions when the upper spacer is put over the upper pad.

According to the constructions described above, the upper pad side hollow convex portions or the lower pad side hollow convex portions are reinforced by the upper side reinforcing plate portions of the upper spacer or the lower side reinforcing plate portions of the lower spacer. Therefore, even when impact is applied, the upper pad side hollow convex portions or the lower pad side hollow convex portions are not broken, but instead reliably protect the article to be packaged from the impact.

In a cushioning material for packaging, having an upper pad and a lower pad respectively having upper pad side hollow convex portions and lower pad, side hollow convex portions protruding in such a fashion as to encompass an accommodation space for an article to be packaged, the cushioning material for packaging of the invention can further include a convex portion and a concave portion one of which enters the other, respectively formed in a lower end face of the upper pad side hollow convex portion and in an upper end face of the lower pad side hollow convex portion.

According to such a construction, the upper pad side hollow convex portions and the lower pad side hollow convex portions engage with one another through the convex portions and the concave portions. Even when impact is applied from the side surfaces, the upper pad and the lower pad are not deviated from each other. Consequently, the impact from the direction of the side surfaces is not transmitted to the article to be packaged through the upper pad or the lower pad.

The embodiment described above preferably can include either an upper spacer having upper side reinforcing plate portions entering the depth of the upper pad side hollow convex portions when the upper spacer is put over the upper pad, or a lower spacer having lower pad side reinforcing plate portions entering the depth of the lower pad side hollow convex portions when the lower spacer is put under the lower pad, or both.

The lower spacer described above preferably includes an opening that is formed in the lower spacer at a portion overlapping plane-wise with a portion where the article to be packaged is accommodated. According to this construction, even when impact is applied from a vertical direction, the impact is not directly transmitted from the lower spacer to the accommodation portion of the article to be packaged in the lower pad. Therefore, the impact transmitted to the article to be packaged from the vertical direction can be mitigated. Similarly, the upper spacer, too, preferably includes an opening that is formed in the upper spacer at a portion overlapping plane-wise with a portion where the article to be packaged is accommodated. According to such a construction, even when impact is applied from the vertical direction, the impact is not directly transmitted from the upper spacer to the accommodation portion of the article to be packaged in the upper pad. Therefore, the impact transmitted to the article to be packaged from the vertical direction can be mitigated.

In the invention, the upper spacer described above can be formed of a corrugated cardboard, for example. The lower spacer, too, can be formed of the corrugated cardboard, for example.

In the invention, the upper and lower spacers may be formed of pulp mold or the like, but are preferably formed of sheet-like plastic foam produced from recycled PET (recycled polyethylene terephthalate). Whereas the pulp mold absorbs the impact when it is broken, the plastic foam absorbs the impact through its deformation, and then returns to its original shape. Therefore, when the upper and lower pads formed of the plastic foam are employed, the appearance before the application of the impact can be retained even after the impact is applied.

Next, in the case of the second type cushioning material for packaging that uses the lower pad but does not use the upper pad, the invention is constituted in the following way. Namely, in a cushioning material for packaging, including a lower pad having lower pad side hollow convex portions protruding in such a fashion as to encompass an accommodation space for an article to be packaged, and an accessory accommodation body put over the article to be packaged accommodated in the lower pad, the cushioning material for packaging of the invention further includes, between the article to be packaged and the accessory accommodation body, an upper spacer having upper side reinforcing plate portions bent along a sidewall portion of the lower pad at positions more outward than the sidewall portion.

In the invention, the article to be packaged is under the state where it is accommodated between the upper spacer and the lower pad. Under this state, the upper spacer keeps contact with the lower surface of the accessory accommodation body the upper part of which has a box shape or tray shape, and the upper side reinforcing plate portions extend from the upper spacer along the sidewall portions of the lower pad at positions more outward than the sidewall portions. Therefore, even when the impact is transmitted from the vertical direction, the upper side reinforcing plate portions of the upper spacer protect the lower pad side hollow convex portions of the lower pad. In other words, even when the impact is transmitted from the vertical direction, the lower pad side hollow convex portions are not broken, but instead reliably protect the article to be packaged from the impact.

In a cushioning material for packaging having a lower pad having lower pad side hollow convex portions protruding in such a fashion as to encompass an accommodation space for an article to be packaged, and an accessory accommodation body put over the article to be packaged accommodated in the lower pad, the cushioning material for packaging according to the invention can further include, between the article to be packaged and the accessory accommodation body, an upper spacer having prismatic hollow portions sandwiched between the article to be packaged and the lower pad side hollow convex portions.

In this invention, too, the article to be packaged is under the state where it is accommodated between the upper spacer and the lower pad. Under this state, the upper spacer keeps contact with the lower surface of the accessory accommodation body the upper part of which has a box shape or tray shape, and the hollow portions of the upper spacer exist between the accessory accommodation body and the lower pad. Therefore, even when the limit of molding exists to the height of the lower pad side hollow convex portions, the article to be packaged having a greater size can be accommodated by the height corresponding to the height of the prismatic hollow portions. In such a case, too, the article to be packaged is protected between the upper spacer and the lower pad from the vertical direction and the direction of the side surfaces, and the impact is not directly transmitted.

In the invention, the upper spacer can be formed of the corrugated cardboard, for example.

In the invention, the sidewall portion of the lower pad is preferably recessed inward to thereby provide a step portion capable of arranging the accessory in the recessed portion. According to such a construction, the accessories such as a power source cable and an instruction manual can be inserted, whenever necessary, by merely forming a window in a side surface of the corrugated cardboard box for exterior decoration.

In a cushioning material for packaging including a lower pad having lower pad side hollow convex portions protruding in such a fashion as to encompass an accommodation space for an article to be packaged, and an accessory accommodation body put over the article to be packaged accommodated in the lower pad, the cushioning material for packaging according to the invention can further have a construction wherein the accessory accommodation body is partitioned by a partition into a plurality of spaces, the partition and a bottom of the accessory accommodation body define between them a space into which an instruction manual among the accessories can be inserted, and a charge port capable of charging the instruction manual into the space defined between the partition and the bottom of the accessory accommodation body is formed in a side surface of the accessory accommodation body.

The accessory accommodation body includes, for example, an accessory accommodation box partitioned by a partition into a plurality of spaces and an accessory accommodation tray accommodated in one of these spaces. The partition and the charge port are formed in the accessory accommodation box, and the accessory accommodation tray and the bottom of the accessory accommodation box define the space into which the instruction manual charged from the charge port can be inserted while passing under the partition.

According to such a construction, the partition partitions the inside of the accessory accommodation body, and the accessories, such as the power source cable, can be accommodated in the respective portions. When the instruction is exchanged, it can be inserted while passing under the partition. Therefore, even when the partition partitions the inside of the accessory accommodation body, the instruction manual can be accommodated across the spaces. The instruction manual can be easily exchanged after the accessories are accommodated in the accessory accommodation body, too.

The invention preferably includes a lower spacer having lower side reinforcing plate portions that enter the depth of the lower pad side hollow convex portions when the lower spacer is put under the lower pad. In this case, too, if an opening is formed in the lower spacer at a portion overlapping plane-wise a portion where the article to be packaged is accommodated, the impact is not directly transmitted from the lower spacer to the article accommodation portion in the lower pad even when the impact is applied from the vertical direction. Therefore, the impact applied to the article to be packaged from the vertical direction can be mitigated. Such a lower spacer, too, can be formed of the corrugated cardboard, for example.

In the invention, a flat sheet-like lower stiffening plate put under the lower pad may be used in place of the lower spacer having the lower side reinforcing portions. In this case, too, an opening is preferably formed in the lower stiffening plate at a portion overlapping plane-wise with a portion where the article to be packaged is accommodated. According to such a construction, the impact is not directly transmitted from the lower stiffening plate to the article accommodation portion of the lower pad even when the impact is applied from the vertical direction. Therefore, the impact applied to the article to be packaged from the vertical direction can be mitigated. The lower stiffening plate, too, can be formed of the corrugated cardboard, for example.

Also in the second type cushioning material for packaging, the upper and lower pads may be formed of pulp mold, but are preferably formed of sheet-like plastic foam produced from recycled PET (recycled polyethylene terephthalate). Whereas the pulp mold absorbs the impact when it is broken, the plastic foam absorbs the impact through its deformation, and then returns to its original shape. Therefore, when the upper and lower pads formed of the plastic foam are employed, the appearance before the application of the impact can be retained even after the impact is applied.

In all embodiments of the invention, the lower pad preferably has a flange portion extended from an edge of a sidewall portion positioned on an outer peripheral side, and the flange portion preferably constitutes the sidewall reinforcing portion in which it is turned back inside the sidewall portion to double the sidewall portion. According to such a construction, the sidewall of the lower pad has the double wall and the strength of the sidewall reinforcing portion to the impact from the vertical direction or from the direction of the side surface can be increased. In this case, reinforcing ribs are preferably formed on the flange portion.

In the invention, the article to be packaged is an electronic apparatus, an electronic apparatus having an optical system mounted therein, or an optical apparatus.

The cushioning material for packaging according to the invention is used for packaging the article to be packaged into the corrugated cardboard box.

When the sidewall portion of the lower pad is recessed inward to thereby define a step portion capable of arranging the accessory in the recessed portion, a window for charging the accessory in the recessed portion is preferably formed in the side surface of the corrugated cardboard box. When the accessory accommodation box having the charge port capable of putting the instruction manual into, and taking it out from, the tray is used as the accessory accommodation body, a window for charging the accessory into the charge port is preferably formed in he side surface of the corrugated cardboard box. According to this construction, the accessories such as the power source cable and the instruction manual can be easily replaced even after packaging is completed.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
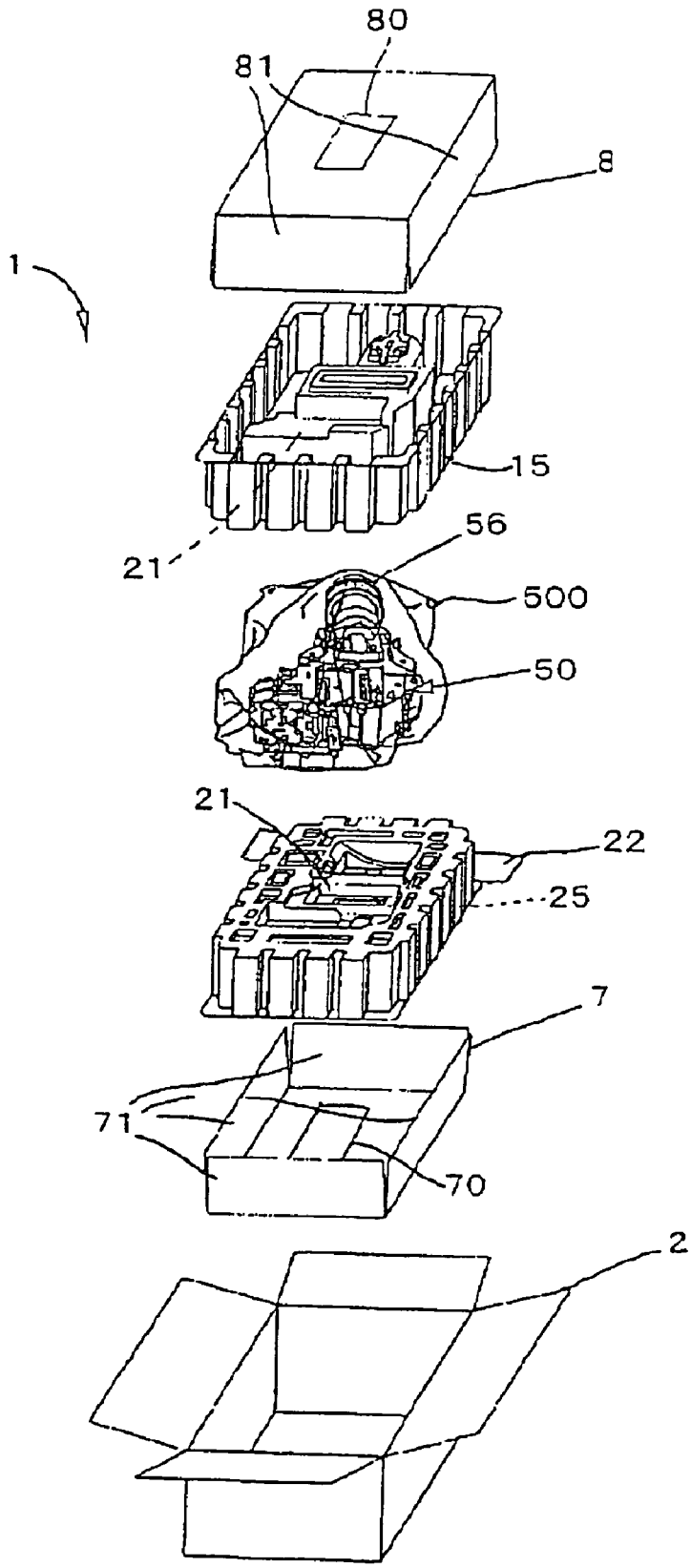
FIG. 1 is an explanatory view showing a mode of packaging a projector (electronic apparatus) as an article to be packaged into a corrugated cardboard box using a cushioning material for packaging according to Embodiment 1 of the invention.

Best mode for carrying out the invention will be explained with reference to the accompanying drawings. Incidentally, all the embodiments that will be hereinafter explained have the same fundamental construction as that of the prior art. Therefore, explanation will be given while like reference numerals are assigned to constituent portions having common functions.

Figure 2:
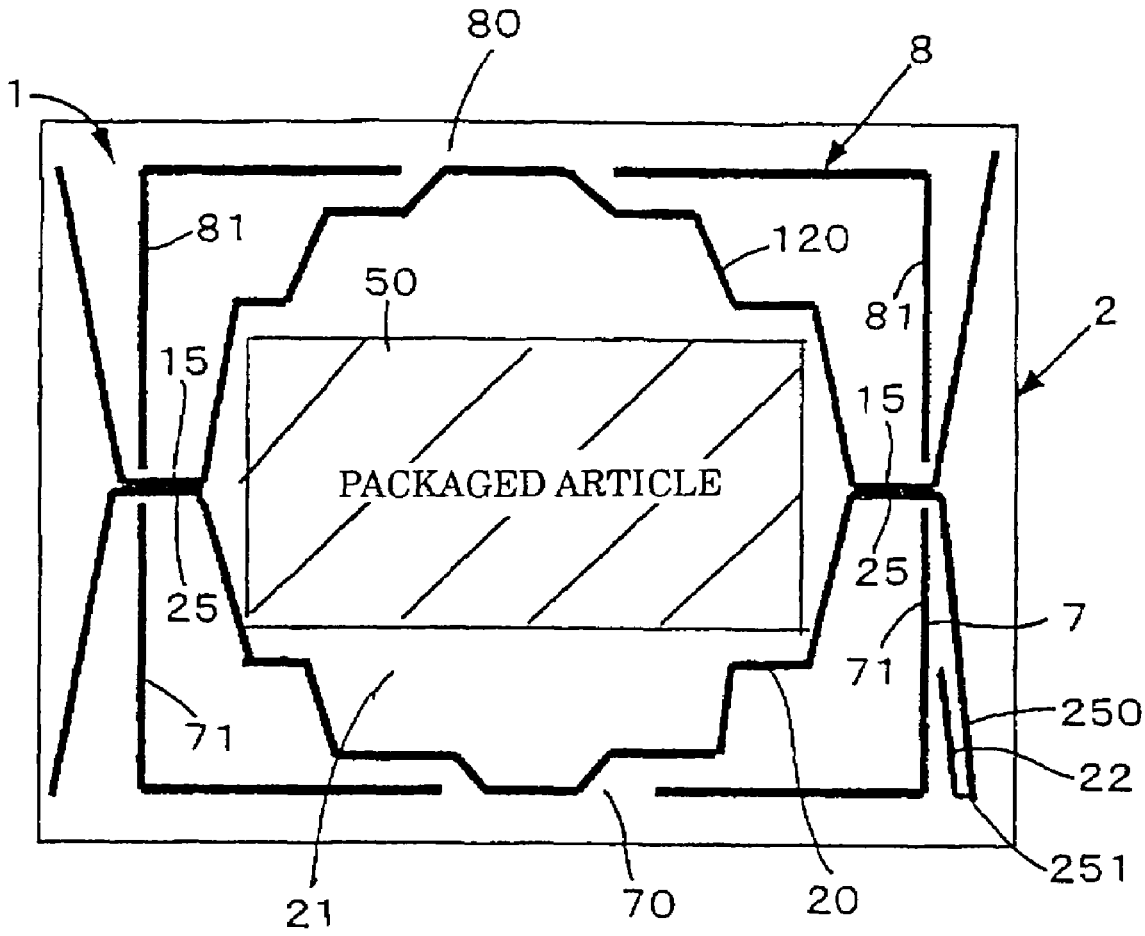
FIG. 2 is a sectional view schematically showing a mode of packaging the projector into the corrugated cardboard box using the cushioning material for packaging shown in FIG. 1.
Figure 3:
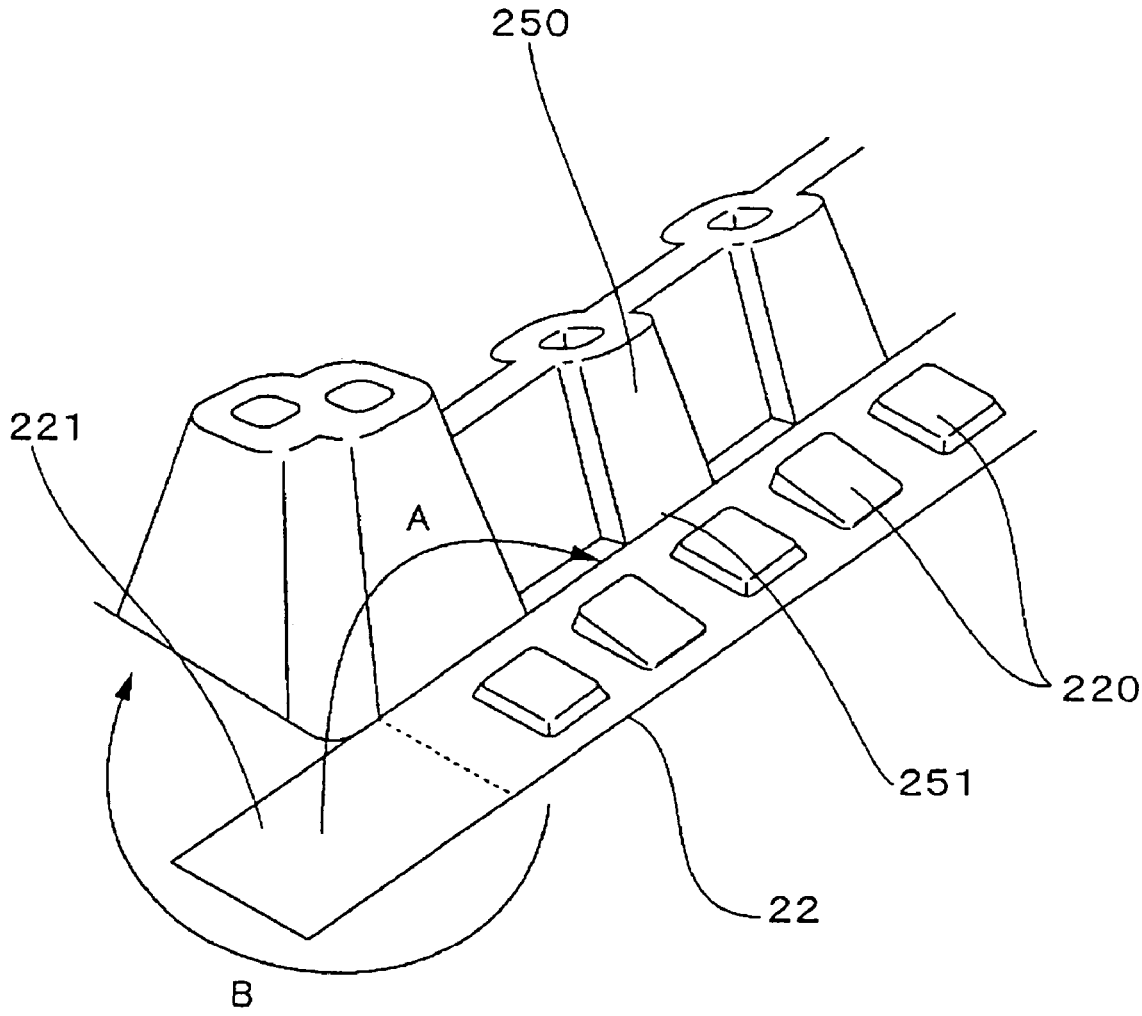
FIG. 3 is an explanatory view showing in magnification a flange portion extended from a lower edge of a sidewall portion positioned on an outer peripheral side of a lower pad used in the cushioning material for packaging shown in FIG. 1.

FIGS. 1 and 2 are respectively an explanatory view showing a mode of packaging an electronic apparatus, such as a projector, as an article to be packaged in corrugated cardboard box using a cushioning material for packaging according to the invention and a sectional view schematically showing the packaging mode. FIG. 3 is an explanatory view showing in magnification a flange portion extended from a lower edge of a sidewall portion positioned on an outer peripheral side of a lower pad used in this embodiment.

Referring to FIGS. 1 and 2, an article to be packaged using a cushioning material 1 for packaging according to the embodiment is a projector (or an optical engine to be mounted in the projector) 50, wherein a projection lens 56 protrudes from a front surface of the projector 50.

To package such a projector 50 in a corrugated cardboard box 2 (a discrete box), in this embodiment a lower spacer 7 formed of corrugated cardboard, a lower pad 20, the projector 50 as the article to be packaged that is wrapped in an anti-static bag 500 having electrical conductivity, an upper pad 10 and an upper spacer 8 formed of corrugated cardboard are put one over another in the foregoing order inside the corrugated cardboard box 2.

A plurality of upper pad side hollow convex portions 15 and a plurality of lower pad side hollow convex portions 25 respectively protrude from the upper pad 10 and from the lower pad 20 in such a fashion as to encompass an accommodation space 21 of the projector 50. A lower end face of each upper pad side hollow convex portion 15 keeps contact with an upper end face of each lower pad side hollow convex portion 25. Therefore, the projector 50 is encompassed by the upper pad side hollow convex portions 15 and the lower pad side hollow convex portions 25 between the upper pad 10 and the lower pad 20 and is protected from vibration during transportation.

Here, a pulp mold can be used for the upper and lower pads 10 and 20, but in this embodiment a molding of plastic foam in a sheet form having a thickness of 2 mm and produced from recycled PET is used. When the pulp mold is used for the upper and lower pads 10 and 20, it absorbs impact by breaking up. In contrast, the plastic foam absorbs impact by deforming and then returns to its original shape after the impact. Therefore, when the upper and lower pads 10 and 20 of the plastic foam are used, even after an impact is applied they can retain the appearance it had before the impact. Moreover, the upper and lower pads 10 and 20 produced from recycled PET have the advantages of both protecting the environmental and reducing cost.

The upper spacer 8 in this embodiment has four upper side reinforcing plate portions 81 that enter deep into the upper pad side hollow convex portions 15 when the upper spacer 8 is put over the upper pad 10, and that are formed in a bent form. Each reinforcing plate portion 81 exhibits a U-shaped section when it is cut in directions of both minor and major sides.

The lower spacer 7, too, has four lower side reinforcing plate portions 71 that enter deep into the lower pad side hollow convex portions 25 when the lower spacer 7 is put under the lower pad 20, and that are formed in a bent form. Each reinforcing plate portion 71 exhibits a U-shaped section when it is cut in directions of both minor and major sides.

In other words, the upper side reinforcing plate portions 81 and the lower side reinforcing plate portions 71 of the upper and lower spacers 8 and 7, respectively, work to reinforce the upper pad side hollow convex portions 15 and the lower pad side hollow convex portions 25. Therefore, even if an impact is applied from both a vertical direction and the direction of the side surfaces, the upper-pad-side hollow convex portions 25 and the lower-pad-side hollow convex portions 15 will not be broken, and will reliably protect the projector 50 from the impact.

In this embodiment, an opening 70 is formed at a center portion of the lower spacer 7 that overlaps plane-wise the accommodation portion of the projector 50. An opening 80 is formed at a center portion of the upper spacer 8 that overlaps plane-wise the accommodation portion of the projector 50. Therefore, even when the accommodation portion of the projector 50 protrudes in the vertical direction into both upper and lower pads 10 and 20, it does not hit the upper and lower spacers 8 and 7. In other words, even if an impact is applied from the vertical direction, the impact will not be directly transmitted from the upper and lower spacers 8 and 7 to the accommodation portion of the projector 50 in the upper and lower pads 10 and 20. Consequently, the impact transmitted to the projector 50 in the vertical direction can be mitigated.

In the embodiment, a flange portion 22 is extended from a lower edge 251 of a sidewall portion 250 positioned on an outer peripheral side of the lower pad 20 as shown in FIG. 3. Both end portions 221 of this flange portion 22 are turned up as indicated by arrow A and are then turned back inside the sidewall portion 250 as indicated by arrow B, thereby constituting side wall reinforcing portions that provide a double wall to the sidewall portions. Since the sidewall portion 250 of the lower pad 20 has the double wall in this embodiment, it has high strength against the impact from the vertical direction or the direction of the side surface. Moreover, because reinforcing ribs 220 are formed on the flange portion 22, the reinforcing effect is high. Though this embodiment explains the arrangement where the flange portion 22 is formed on one side of the lower pad 20, the flange portion may be formed on the other side of the lower pad 20 or on the upper pad 10 depending on the sizes of the lower and upper pad 20 and 10 or on the size of the raw material forming these pads.

Embodiment 2

Figure 4:
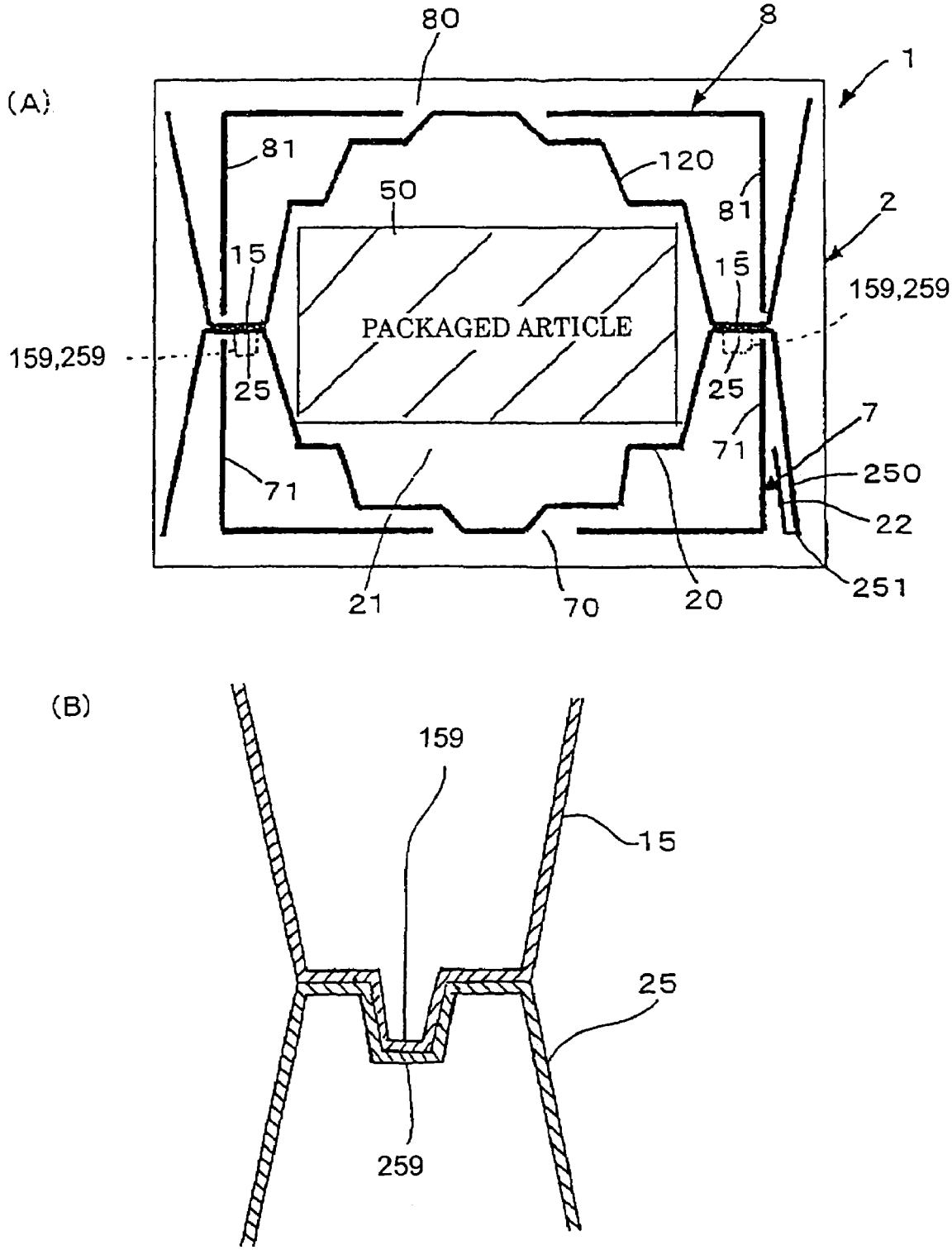
FIGS. 4A and 4B are a sectional view showing a mode of packaging a projector (electronic apparatus) as an article to be packaged using a cushioning material for packaging according to Embodiment 2 of the invention and a sectional view showing in magnification an overlap portion between an upper pad side hollow convex portion and a lower pad side hollow convex portion, respectively.
Figure 5:
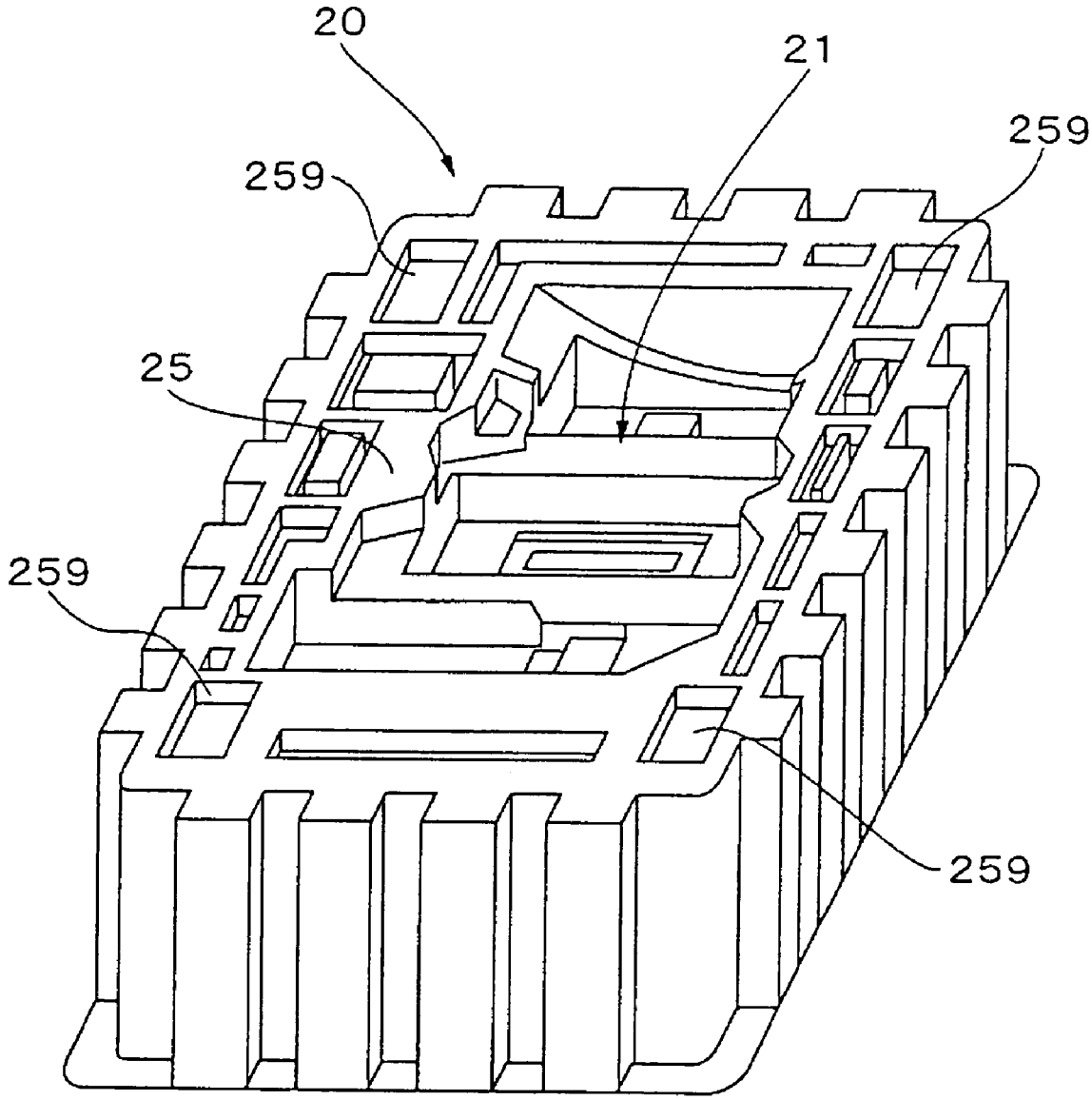
FIG. 5 is a perspective view showing an example of a lower pad used in the cushioning material for packaging shown in FIG. 4.

FIGS. 4A and 4B are respectively a sectional view showing a mode of packaging a projector (an electronic apparatus) as an article to be packaged in a corrugated cardboard box using a cushioning material for packaging according to Embodiment 2 of the invention, and a sectional view showing in magnification an overlap portion between an upper-pad-side hollow convex portion 15 and a lower-pad-side hollow convex portion 25. FIG. 5 is a perspective view showing an example of a lower pad used in the cushioning material for packaging in this embodiment. Since the cushioning material for packaging according to this embodiment has fundamentally the same construction as that of Embodiment 1, like reference numerals will be used to identify portions having common functions and their explanation will be omitted.

To package the projector 50 in the corrugated cardboard box 2 (a discrete box), in this embodiment, too, the lower spacer 7 formed of corrugated cardboard, the lower pad 20 formed of sheet-like plastic foam, the projector 50 as the article to be packaged, that is wrapped in an anti-static bag 500 having electrical conductivity, the upper pad 10 formed of sheet-like plastic foam and the upper spacer 8 formed of corrugated cardboard are put one over another in the foregoing order inside the corrugated cardboard box 2 as shown in FIG. 4A.

A plurality of upper pad side hollow convex portions 15 and a plurality of lower pad side hollow convex portions 25, respectively, protrude from the upper pad 10 and from the lower pad 20 in such a fashion as to encompass the accommodation space 21 of the projector 50. The lower end face of each upper pad side hollow convex portion 15 keeps contact with the upper end face of each lower pad side hollow convex portion 25. Therefore, the projector 50 is encompassed by the upper pad side hollow convex portions 15 and the lower pad side hollow convex portions 25 between the upper pad 10 and the lower pad 20 and is protected from vibration during transportation.

In this embodiment, a convex portion 159 is formed on the lower end face of each upper pad side hollow convex portion 15 while a concave portion 259 mating with the convex portion 159 is formed on the upper end face of each lower pad side hollow convex portion 25 as shown in FIG. 4B. Such a convex portion 259 can be formed, for example, at four corners of the lower pad side hollow convex portion 25 of the lower pad 20 that is so formed as to encompass the accommodation space 21 for the projector 50 as shown in FIG. 5.

In the cushioning material 1 for packaging having such a construction, the upper pad side hollow convex portion 15 and the lower pad side hollow convex portion 25 can be engaged with each other at the convex portion 159 and the concave portion 259. Therefore, even if an impact is applied from the direction of the side surface, the upper pad 10 and the lower pad 20 will not deviate from each other, and the wall surface of the upper-pad-side hollow convex portion 15 will not hit the projector 50 hard. In consequence, the impact from the direction of the side surface is not transmitted to the projector 50 through the upper pad 10 or the lower pad 20.

Incidentally, it is also possible to employ a construction in which a concave portion is formed on the lower end face of the upper pad side hollow convex portion 15 and another concave portion, into which the convex portion formed on the lower end face of the upper pad side hollow convex potion fits, is formed on the upper end face of the lower pad side hollow convex portion 25.

Figure 6:
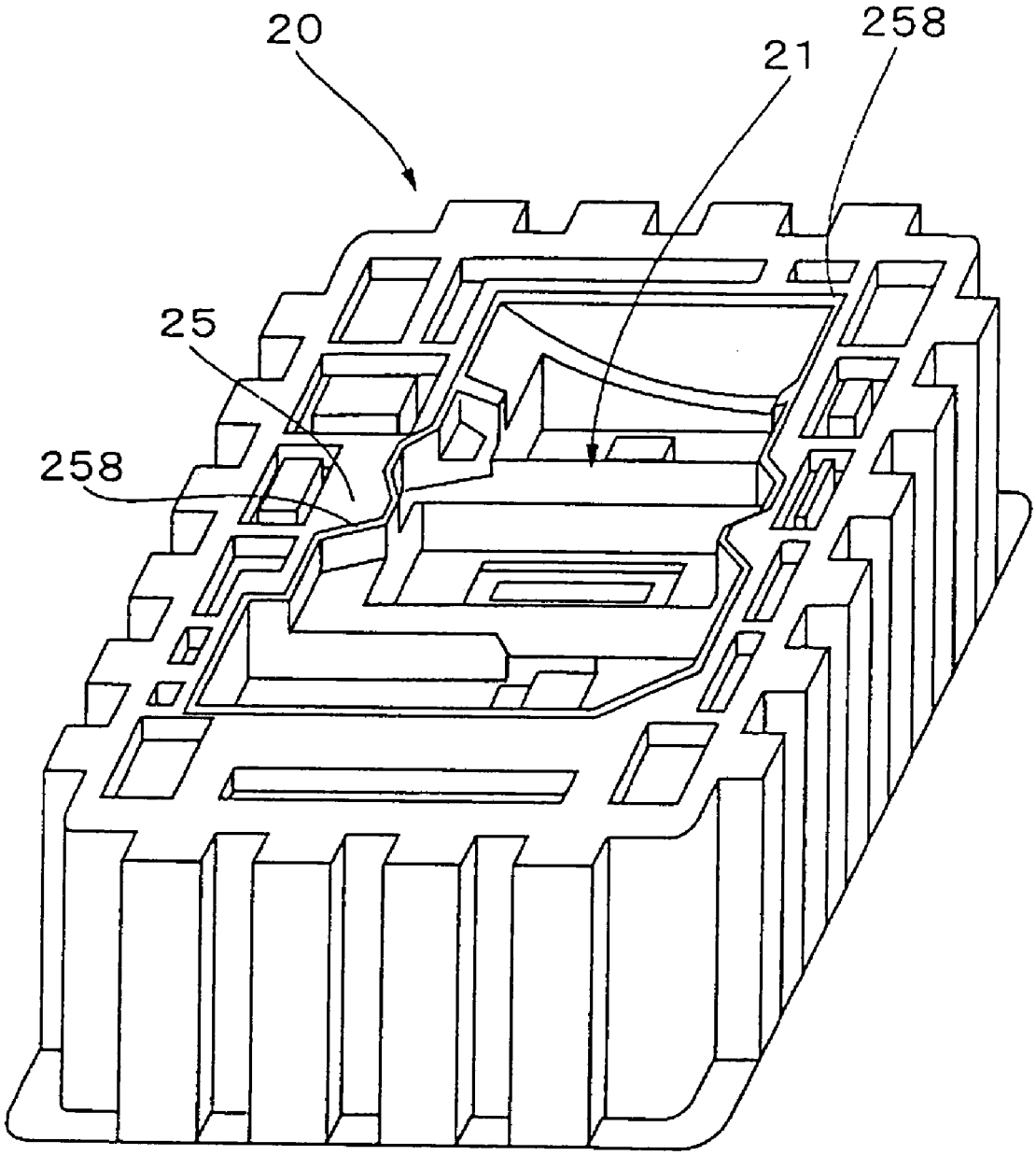
FIG. 6 is a perspective view showing a lower pad used in a cushioning material for packaging according to Embodiment 3 of the invention.
Figure 7:
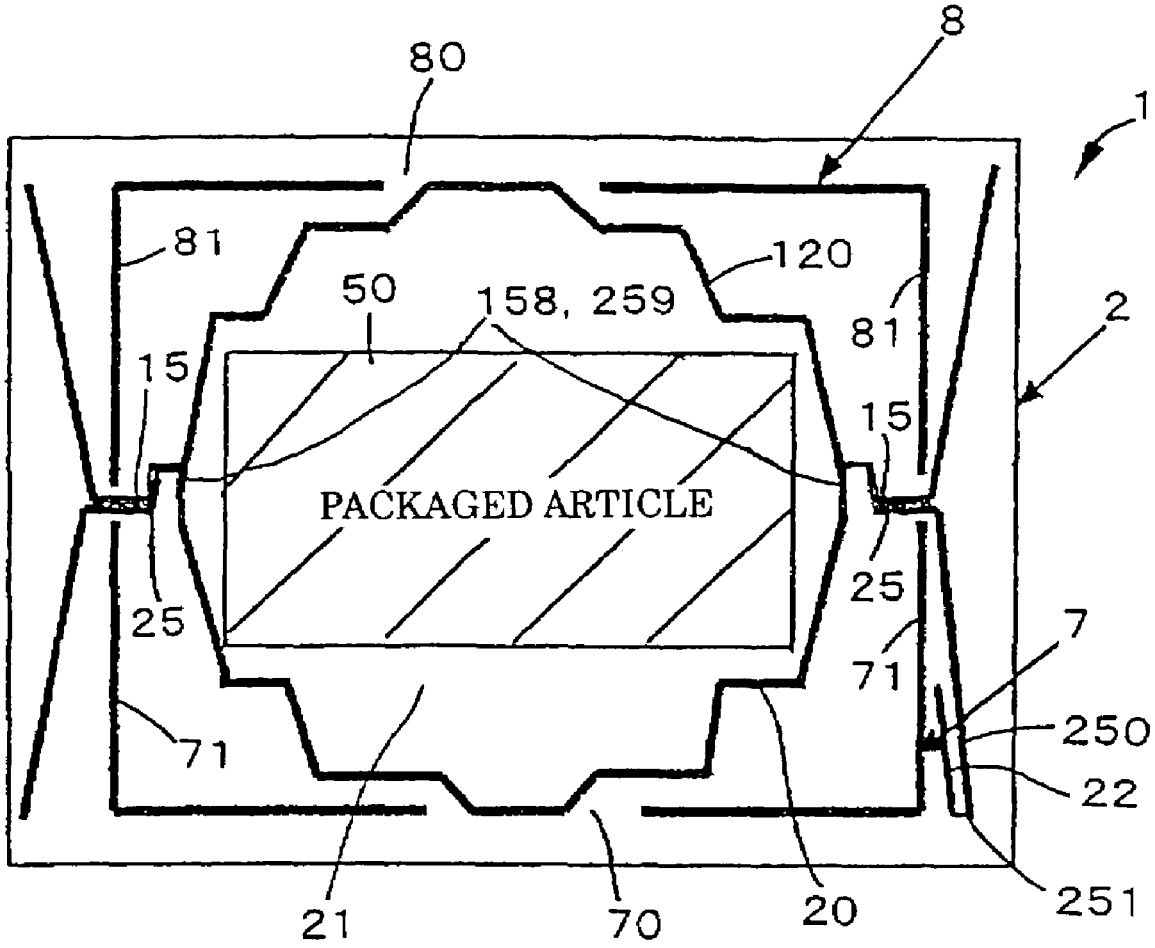
FIG. 7 is a sectional view schematically showing a mode of packaging a projector (electronic apparatus) as an article to be packaged into a corrugated cardboard box using a cushioning material for packaging having the lower pad shown in FIG. 6.

FIGS. 6 and 7 are respectively a perspective view showing a lower pad used in a cushioning material for packaging according to Embodiment 3 of the invention and a sectional view schematically showing a mode of packaging a projector (an electronic apparatus) as an article to be packaged in a corrugated cardboard box using the cushioning material for packaging having the lower pad. Since the cushioning material for packaging according to this embodiment has fundamentally the same construction as that of Embodiment 1, like reference numerals will be used to identify portions having common functions and their explanation will be omitted.

To package the projector 50 in the corrugated cardboard box 2 (a discrete box), in this embodiment, too, the lower spacer 7 formed of corrugated cardboard, the lower pad 20 formed of sheet-like plastic foam, the projector 50 as the article to be packaged that is wrapped in an anti-static bag 500 having electrical conductivity, the upper pad 10 formed of sheet-like plastic foam and the upper spacer 8 formed of corrugated cardboard are put one over another in the foregoing order inside the corrugated cardboard box 2 as shown in FIGS. 6 and 7.

A plurality of upper pad side hollow convex portions 15 and a plurality of lower pad side hollow convex portions 25 respectively protrude from the upper pad 10 and from the lower pad 20 in such a fashion as to encompass the accommodation space 21 of the projector 50. The lower end face of each upper pad side hollow convex portion 15 keeps contact with the upper end face of each lower pad side hollow convex portion 25. Therefore, the projector 50 is encompassed by the upper pad side hollow convex portions 15 and the lower pad side hollow convex portions 25 between the upper pad 10 and the lower pad 20 and is protected from vibration during transportation.

In this embodiment, rib-like convex portions 158 are formed on the upper end face of the lower pad side hollow convex portions 25 throughout the entire periphery of the accommodation space 21 of the projector 50 as shown in FIG. 6. On the other hand, annular concave portions 158 into which the rib-like convex portions 158 of the lower pad side hollow convex portions 15 fit are formed on the lower end face of the upper pad side hollow convex portions 15.

Therefore, the upper pad side hollow convex portions 15 and the lower pad side hollow convex portions 25 can be engaged with each other at the concave portions 158 and the convex portions 258. So, even if an impact is applied from the direction of the side surface, the upper pad 10 and the lower pad 20 will not deviate from each other, and the wall surface of the upper pad side hollow convex portions 15 will not hit the projector 50 hard. Consequently, the impact from the direction of the side surface is not transmitted to the projector 50 through the upper pad 10 or the lower pad 20. The rib-like convex portions 158 and the annular concave portions 158 work to reinforce the periphery of the accommodation space 21 of the projector 50 of the lower pad side hollow convex portions 15 and the periphery of the accommodation space 21 of the projector 500 of the upper-pad-side hollow convex portions 15, which provides the advantage that the lower-pad-side hollow convex portions 25 and the upper-pad-side hollow convex portions 15 have high strength. This embodiment is particularly effective, for example, when a circuit board is arranged on the upper surface of the projector 50 and the upper pad 10 has to be prevented from hitting the upper end face of the projector 50 or its corner portions.

The concave portions 258 of the lower pad side hollow convex portions 25 and the convex portions 158 of the upper pad side hollow convex portions are formed throughout the entire periphery of the accommodation space 21 of the projector 50, but may be partially interrupted so long as they are formed in such a fashion as to encompass the accommodation space 21 of the projector 50. Rib-like convex portions may be formed on the lower end face of the upper-pad-side hollow convex portions 15 while annular concave portions may be formed on the upper end face of the lower-pad-side hollow convex portions 25.

Figure 8:
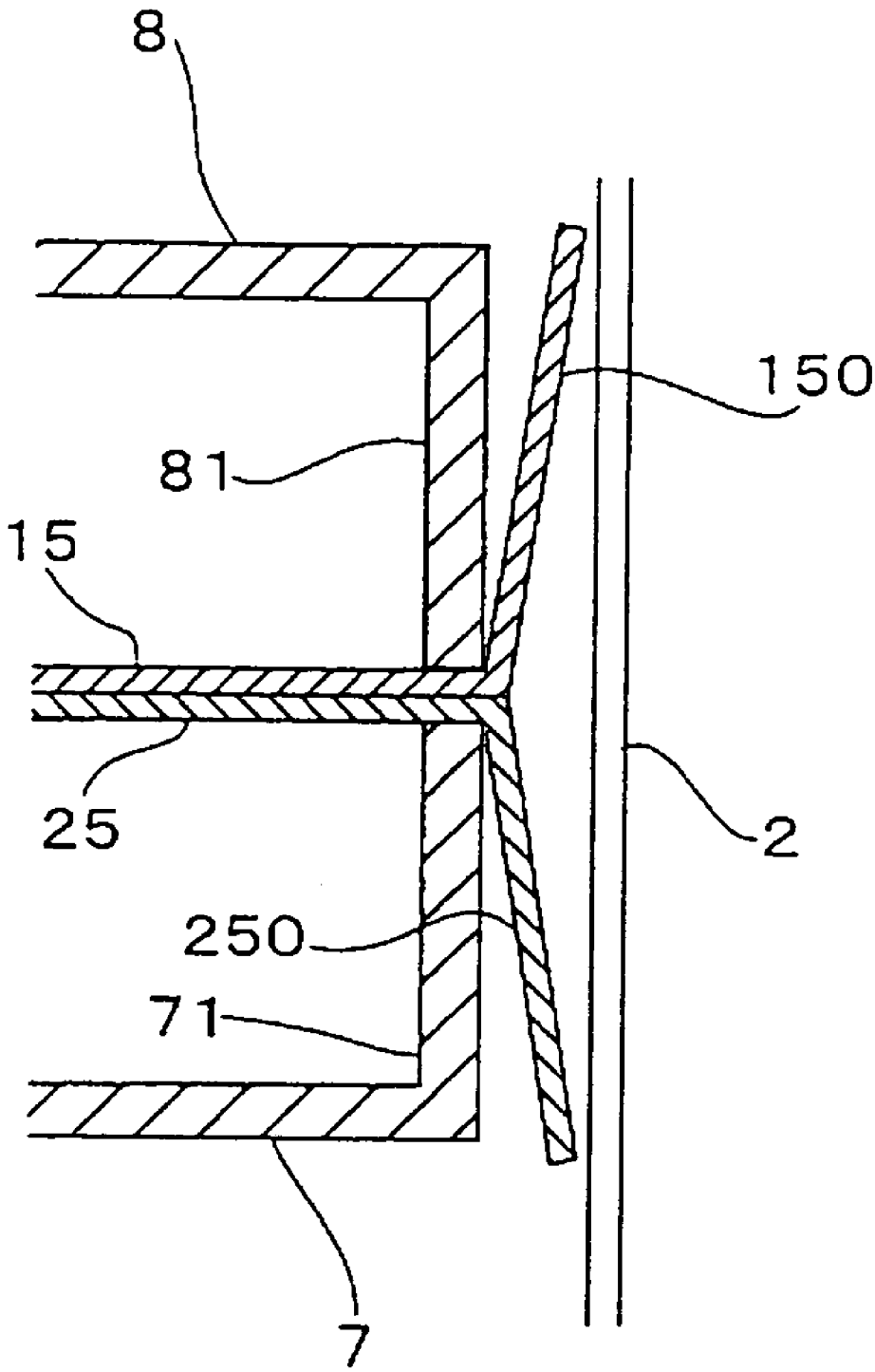
FIG. 8 is a sectional view schematically showing main portions of a cushioning material for packaging according to Embodiment 4 of the invention.

FIG. 8 is a sectional view schematically showing main portions of a cushioning material for packaging according to Embodiment 4 of the invention. Since the cushioning material for packaging according to this embodiment has fundamentally the same construction as that of Embodiment 1, like reference numerals will be used to identify portions having common functions and their explanation will be omitted.

The overall construction of this embodiment is as follows. To package the projector 50 in the corrugated cardboard box 2 (a discrete box), in this embodiment, too, the lower spacer 7 formed of corrugated cardboard, the lower pad 20 formed of sheet-like plastic foam, the projector 50 as the article to be packaged that is wrapped in an anti-static bag 500 having electrical conductivity, the upper pad 10 formed of sheet-like plastic foam and the upper spacer 8 formed of corrugated cardboard are put one over another in the foregoing order, as has been explained with reference to FIGS. 1 and 2. In the upper and lower pads 10 and 20, a plurality of upper-pad-side hollow convex portions 15 and a plurality of lower-pad-side hollow convex portions 25 respectively protrude from the upper pad 10 and the lower pad 20 in such a fashion as to encompass the accommodation space 21 for the projector 50. The lower end face of each upper pad side hollow convex portion 15 keeps contact with the upper end face of each lower pad side hollow convex portion 25. Therefore, the projector 50 is encompassed by the upper pad side hollow convex portions 15 and the lower pad side hollow convex portions 25 between the upper pad 10 and the lower pad 20 and is protected from vibration during transportation.

The upper spacer 8 has four upper side reinforcing plate portions 81 that enter deep into the upper-pad-side hollow convex portions 15 when the upper spacer 8 is put over the upper pad 10, and that are formed in a bent form. Each reinforcing plate portion 81 exhibits a U-shaped section when it is cut in directions of both minor and major sides. The lower spacer 7, too, has four lower side reinforcing plate portions 71 that enter deep into the lower-pad-side hollow convex portions 25 when the lower spacer 7 is put under the lower pad 20, and that are formed in a bent form. Each reinforcing plate portion 71 exhibits a U-shaped section when it is cut in directions of both minor and major sides.

Here, since both upper and lower pads 10 and 20 are formed of sheet-like plastic foam, sidewall portions 150 and 250 having a taper of about 2 degrees are likely to sag with the passage of time. Therefore, the upper side reinforcing plate portion 81 of the upper spacer 8 and the lower side reinforcing plate portion 71 of the lower spacer 7 are in abutment against the roots of the sidewall portions 150 and 250 of the upper and lower pads 10 and 20, respectively, as shown in FIG. 8. In consequence, the sidewall portions 150 and 250 of the upper and lower pads 10 and 20 are sandwiched between the upper side reinforcing plate portion 81 of the upper spacer 8 and the side surface portion of the corrugated cardboard box 2 and also between the lower side reinforcing plate portion 71 of the lower spacer 7 and the side surface portion of the corrugated cardboard box 2. The sidewall portions 150 and 250 of the upper and lower pads 10 and 20 can thus be prevented from deformation.

Figure 9:
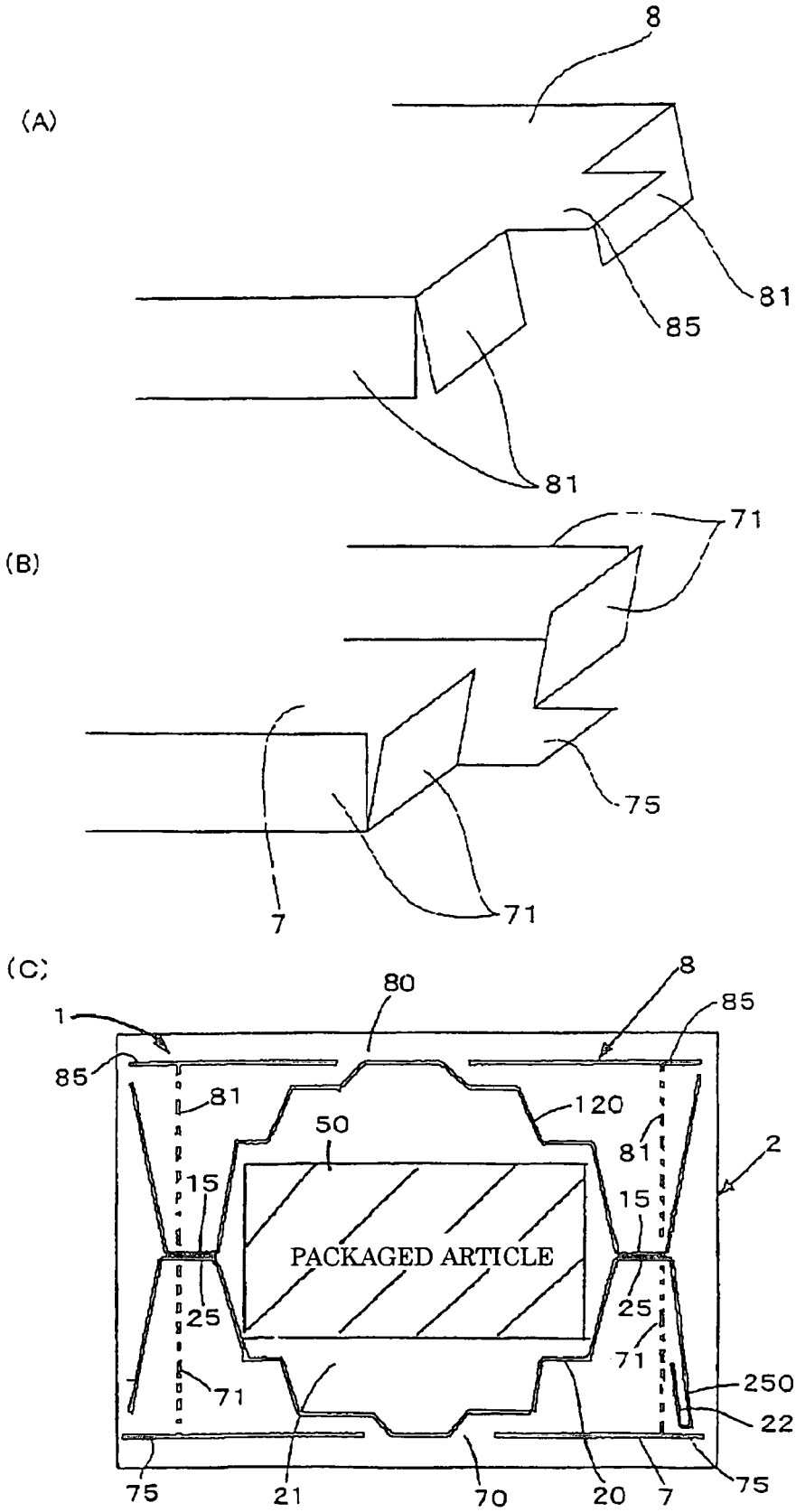
FIGS. 9A, 9B and 9C are a perspective view showing main portions of an upper pad used for a cushioning material for packaging according to Embodiment 5 of the invention, a perspective view schematically showing main portions of a lower pad used for this cushioning material for packaging, and a sectional view schematically showing a mode of packaging a projector (electronic apparatus) as an article to be packaged into a corrugated cardboard box using the cushioning material for packaging, respectively.

FIGS. 9A, 9B and 9C are a perspective view showing main portions of an upper pad used for a cushioning material for packaging according to Embodiment 5 of the invention, a perspective view schematically showing main portions of a lower pad used for this cushioning material for packaging, and a sectional view schematically showing a mode of packaging a projector (an electronic apparatus) as an article to be packaged in a corrugated cardboard box using the cushioning material for packaging. Incidentally, since the cushioning material for packaging according to this embodiment has fundamentally the same construction as that of Embodiment 1, like reference numerals will be used to identify portions having common functions and their explanation will be omitted.

The overall construction of this embodiment is as follows. To package the projector 50 in the corrugated cardboard box 2 (a discrete box), in this embodiment, too, the lower spacer 7 formed of corrugated cardboard, the lower pad 20 formed of sheet-like plastic foam, the projector 50 as the article to be packaged that is wrapped in an anti-static bag 500 having electrical conductivity, the upper pad 10 formed of sheet-like plastic foam and the upper spacer 8 formed of corrugated cardboard are put one over another in the foregoing order, as has been explained with reference to FIGS. 1 and 2.

In the upper and lower pads 10 and 20, a plurality of upper-pad-side hollow convex portions 15 and a plurality of lower-pad-side hollow convex portions 25 respectively protrude from the upper pad 10 and the lower pad 20 in such a fashion as to encompass the accommodation space 21 for the projector 50. The lower end face of each upper pad side hollow convex portion 15 keeps contact with the upper end face of each lower-pad-side hollow convex portion 25. Therefore, the projector 50 is encompassed by the upper-pad-side hollow convex portions 15 and the lower-pad-side hollow convex portions 25 between the upper pad 10 and the lower pad 20 and is protected from vibration during transportation.

The upper spacer 8 has four upper side reinforcing plate portions 81 that enter deep into the upper side hollow convex portions 15 when the upper spacer 8 is put over the upper pad 10, and that are formed in a bent form. Each reinforcing plate portion 81 exhibits a U-shaped section when it is cut in directions of both minor and major sides. The lower spacer 7, too, has four lower side reinforcing plate portions 71 that enter deep into the lower side hollow convex portions 25 when the lower spacer 7 is put under the lower pad 20, and that are formed in a bent form. Each reinforcing plate portion 71 exhibits a U-shaped section when it is cut in directions of both minor and major sides.

Here, two lower side reinforcing plates 71 and two lower side reinforcing plate portions 81 are formed in a bent form on both sides of the same side of the lower and upper spacers 7 and 8 as shown in FIGS. 9A, 9B and 9C, and portions 75 and 85 between them extend sideways as such and hit the side surfaces of the corrugated cardboard box 2. Therefore, this embodiment has high impact resistance from the side directions.

Figure 10:
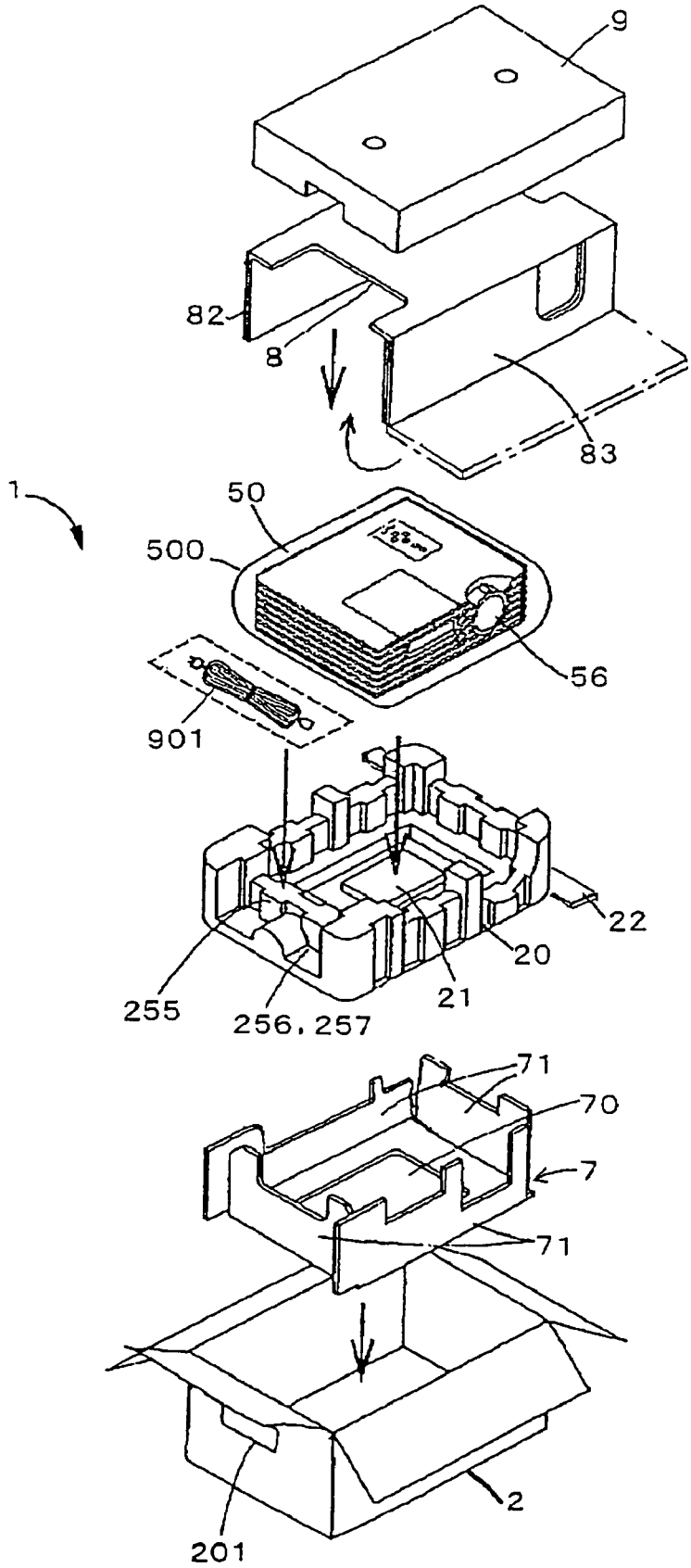
FIG. 10 is an explanatory view showing a mode of packaging a projector into a corrugated cardboard box using a cushioning material for packaging according to Embodiment 6 of the invention.
Figure 11:
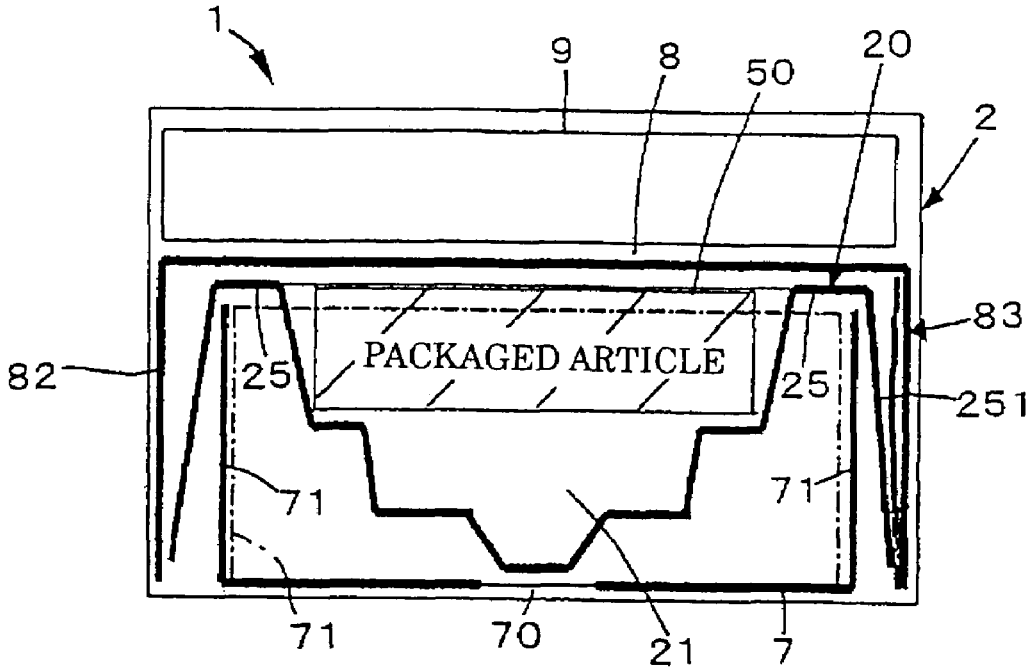
FIG. 11 is a sectional view schematically showing a condition where the corrugated cardboard box packaged as shown in FIG. 10 is cut in a minor side direction.
Figure 12:
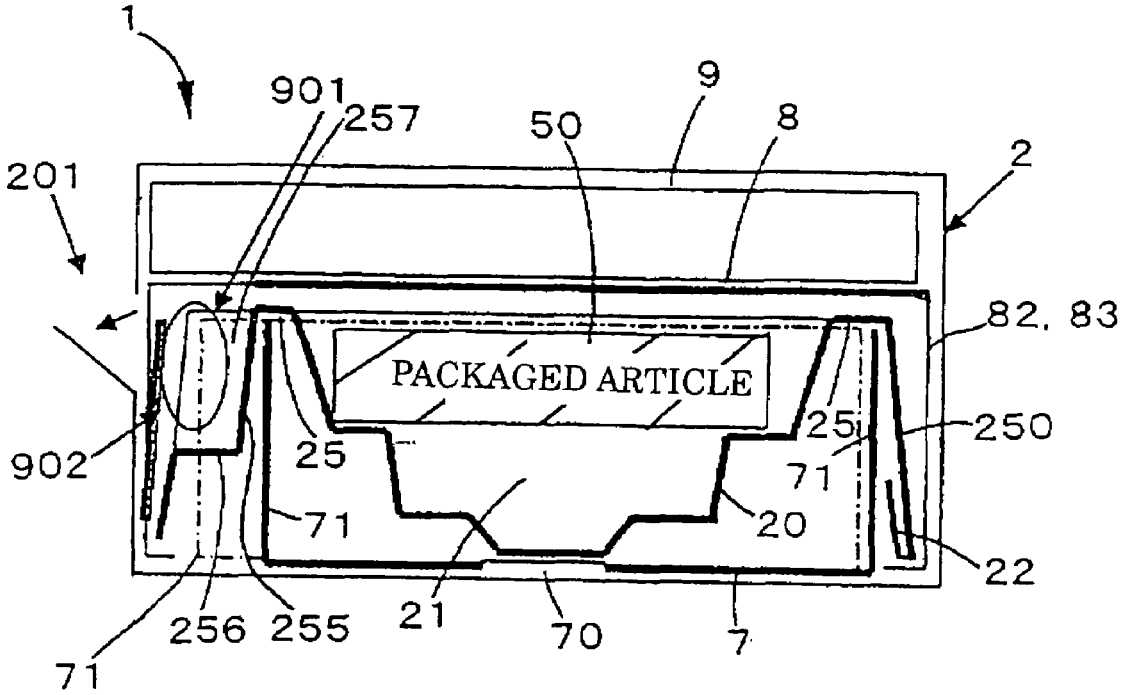
FIG. 12 is a sectional view schematically showing a condition where the corrugated cardboard box packaged as shown in FIG. 10 is cut in a major side direction.

FIGS. 10, 11 and 12 are respectively an explanatory view showing a mode of packaging a projector (an electronic apparatus) as an article to be packaged in a corrugated cardboard box using a cushioning material for packaging according to Embodiment 6 of the invention, a sectional view schematically showing a condition where the corrugated cardboard box packaging the projector is cut in a minor side direction, and a sectional view schematically showing a condition where the corrugated cardboard box packing the projector is cut in a major side direction.

In FIGS. 10, 11 and 12, an article that is to be packaged using the cushioning material 1 for packaging according to this embodiment is a projector (or an optical engine mounted in the projector) 50, wherein a projection lens 56 protrudes from front surface of the projector 50.

To package such a projector 50 in the corrugated cardboard box 2 (a discrete box), in this embodiment, the lower spacer 7 formed of corrugated cardboard, the lower pad 20, the projector 50 as the article to be packaged that is wrapped in an anti-static bag 500 having electrical conductivity, the upper spacer 8 made of corrugated cardboard and the accessory accommodation box 9 are put one over another in the foregoing order inside the corregated cardboard box 2. Here, the accessory accommodation box 9 accommodates a remote controller among various accessories.

A plurality of lower pad side hollow convex portions 25 of the lower pad 20 protrude in such a fashion as to encompass the accommodation space 21 for the projector 50. Therefore, the projector 50 is encompassed by the lower-pad-side hollow convex portions 25 between the lower pad 20 and the upper spacer 8, and is protected from vibration during transportation. The flange portion 22 that is explained with reference to FIG. 3 is formed at the lower end of the sidewall portion 250 of the lower pad 20. Here, a pulp mold can be used for the lower pad 20, but a molding of sheet-like plastic foam having a thickness of 3 mm and produced from recycled PET is used in this embodiment.

The lower spacer 7 has four lower side reinforcing plate portions 71 that enter deep into the lower-pad-side hollow convex portions 25 when the lower spacer 7 is put under the lower pad 20, and that are formed in a bent form. Each reinforcing plate portion 71 exhibits a U-shaped section when it is cut in directions of both minor and major sides. Here, the lower side reinforcing plate portions 71 have different height corresponding to the shape of the lower pad side hollow convex portions 25.

In contrast, the upper spacer 8 is provided on the side of its opposing major sides with two upper side reinforcing plate portions 82 and 83 that are bent along the sidewall portions 251 at positions more outward than the sidewall portions 250 of the lower pad 20. The lower edge portions of these upper side reinforcing plate portions 82 and 83 substantially reach the bottom of the corrugated cardboard box 2. Of these two upper side reinforcing plate portions 82 and 83, the upper side reinforcing plate portion 83 on the positioning side of the projection lens 56 has a double-fold structure.

When the cushioning material 1 for packing having the construction described above is used, the projector 50 is accommodated between the upper spacer 8 and the lower pad 20. In this condition, the upper part of the upper spacer 8 keeps contact with the lower surface of the accessory accommodation box 9, and the upper side reinforcing plate portions 82 and 83 extend downward from the upper spacer 8 at the positions outside the sidewall portions 251 of the lower pad 20. Therefore, even if an impact is applied from the vertical direction, the upper side reinforcing plate portions 82 and 83 will protect the lower-pad-side hollow convex portions 25 of the lower pad 20. In other words, even if an impact is applied from the vertical direction, the lower-pad-side hollow convex portions 25 will not be broken and will protect the projector 50 from the impact.

In this embodiment, the opening 70 is formed at the center portion of the bottom of the lower spacer 7 that overlaps plane-wise the accommodation portion of the projector 50. Therefore, even when the accommodation portion of the projector 50 protrudes downward in the lower pad 20, it does not hit the lower spacer 7. In other words, even if an impact is applied from the vertical direction, the impact will not be directly transmitted from the lower spacer 7 to the accommodation portion of the projector 50 in the lower pad 20. Consequently, the impact transmitted to the projector 50 from the vertical direction can be mitigated.

In this embodiment, the sidewall portion 255 of the lower pad 20 is recessed inward to define a step portion 257 capable of accommodating the accessory in this recess portion 256. A window 201 for putting a power source cable and an instruction manual among the accessories into the recess portion 256 is formed in the side surface of the corrugated cardboard box 2. Therefore, the accessory such as the power source cable 901 and the instruction manual 902 can be put easily even after the projector 50 is completely packaged in the corrugated cardboard box 2 using the cushioning material 1 for packaging.

Moreover, the upper side reinforcing plate portions 82 and 83 of the spacer 8 extend towards the side surfaces of the corrugated cardboard box 2 on the side of the recess portion 256 of the lower pad 20. For this reason, even if an impact is applied from the sides, the impact will be borne by the upper reinforcing plate portions 82 and 83 of the upper spacer 8.

Figure 13:
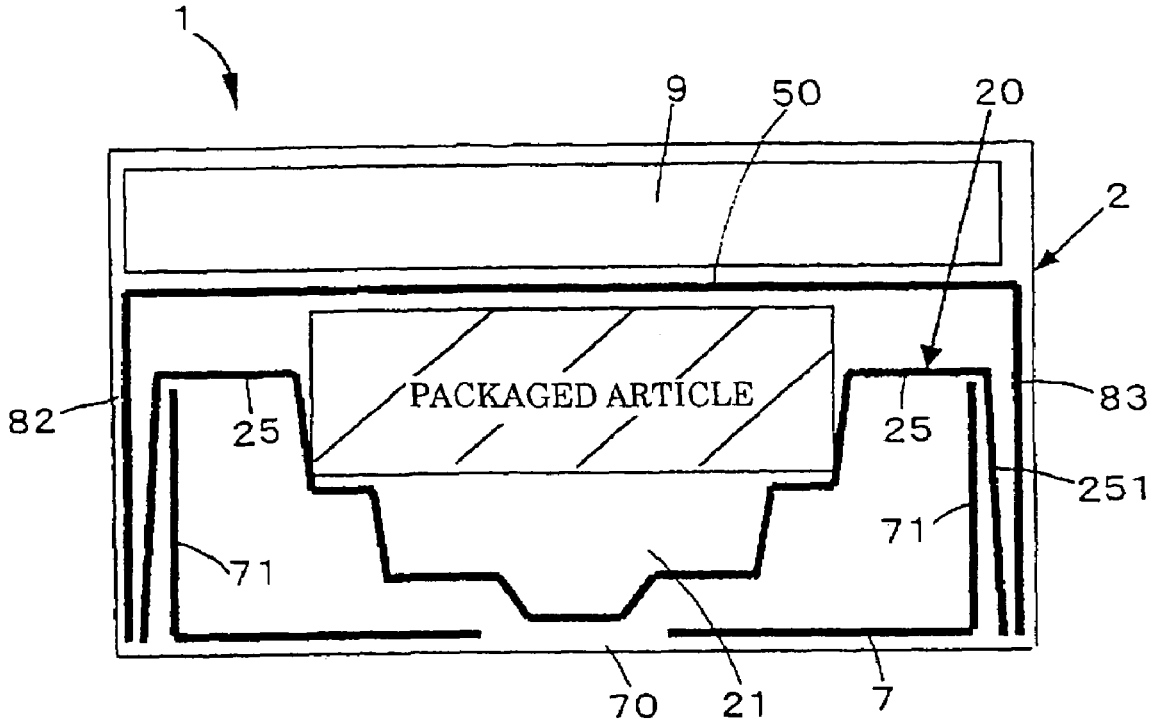
FIG. 13 is a sectional view schematically showing a condition where the corrugated cardboard box into which a projector is packaged as shown in FIG. 10 using a cushioning material for packaging according to Embodiment 7 is cut in a minor side direction.
Figure 14:
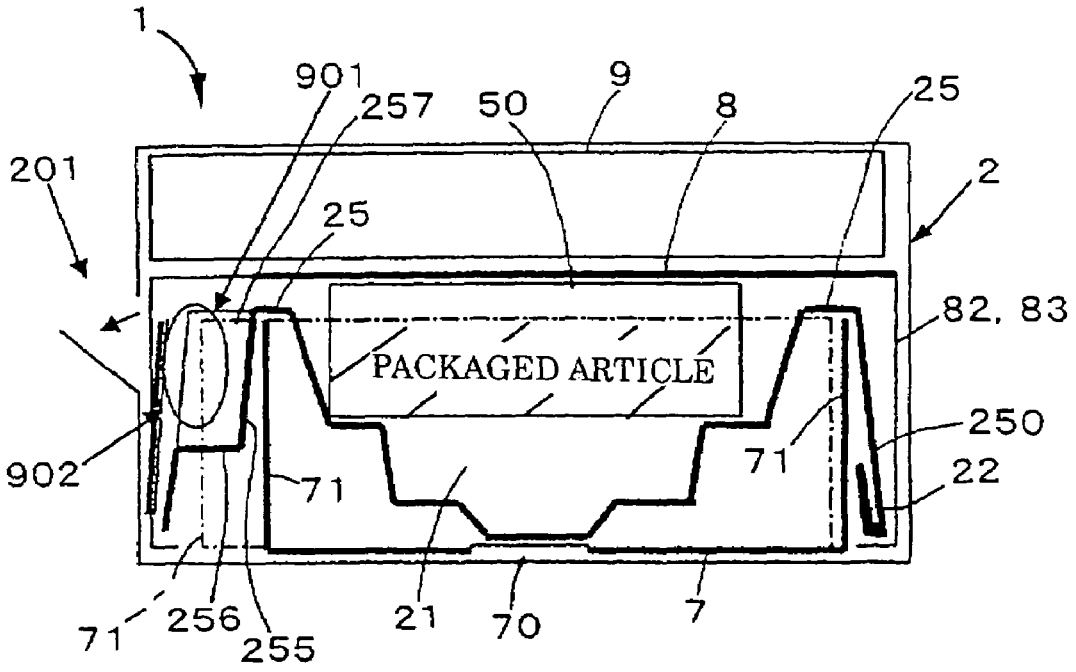
FIG. 14 is a sectional view schematically showing a condition where the corrugated cardboard box packaged as shown in FIG. 13 is cut in a major side direction.

FIGS. 13 and 14 are a sectional view schematically showing a condition where a corrugated cardboard box, into which a projector (an electronic apparatus) as an article to be packaged is packaged using a cushioning material for packaging according to Embodiment 7 of the invention, is cut in a minor side direction, and a sectional view schematically showing a condition where the corrugated cardboard box is cut in a major side direction. Incidentally, since the cushioning material for packaging according to this embodiment has fundamentally the same construction as that of Embodiment 5, like reference numerals will be used to identify portions having common functions and their explanation will be omitted.

In FIGS. 13 and 14, an article to be packaged using the cushioning material 1 for packaging according to this embodiment is a projector (or an optical engine mounted in the projector) 50. To package such a projector 50 in the corrugated cardboard box 2 (a discrete box), in this embodiment, the lower spacer 7 formed of corrugated cardboard, the lower pad 20 formed of sheet-like plastic foam, the projector 50 as the article to be packaged that is wrapped in an anti-static bag 500 having electrical conductivity, the upper spacer 8 formed of corrugated cardboard and the accessory accommodation box 9 are put one over another in the foregoing order, inside the corrugated cardboard box 2.

A plurality of lower-pad-side hollow convex portions 25 of the lower pad 20 protrude in such a fashion as to encompass the accommodation space 21 of the projector 50. Therefore, the lower-pad-side hollow convex portions 25 encompass the projector 50 between the lower pad 20 and the upper spacer 8.

In this embodiment, however, since the projector 50 has a greater height the upper surface of the projector 50 sticks out significantly from the upper end face of the lower-pad-side hollow convex portions 25 of the lower pad 20. The upper spacer 8 used in this embodiment is provided on the side of its opposing major sides with two upper side reinforcing plate portions 82 and 83 that are bent along the sidewall portions 251 at positions more outward than the sidewall portions 250 of the lower pad 20. The lower end portions of these upper side reinforcing plate portions 82 and 83 substantially reach the bottom of the corrugated cardboard box 2. Therefore, the projector 50 is accommodated between the upper spacer 8 and the lower pad 20. In this condition, even if an impact is applied from the vertical direction, the upper side reinforcing plate portions 82 and 83 of the upper spacer 8 will protect the projector 50. Consequently, the projector 50 can be reliably protected from the impact, even if the hollow convex portions 25 on the lower pad side which correspond to the height of the projector 50 cannot be formed because of a limit in the deep-drawing dimensions when molding the lower pad 20 from the sheet-like foam that has a thickness of 3 mm and is formed of recycled PET.

Figure 15:
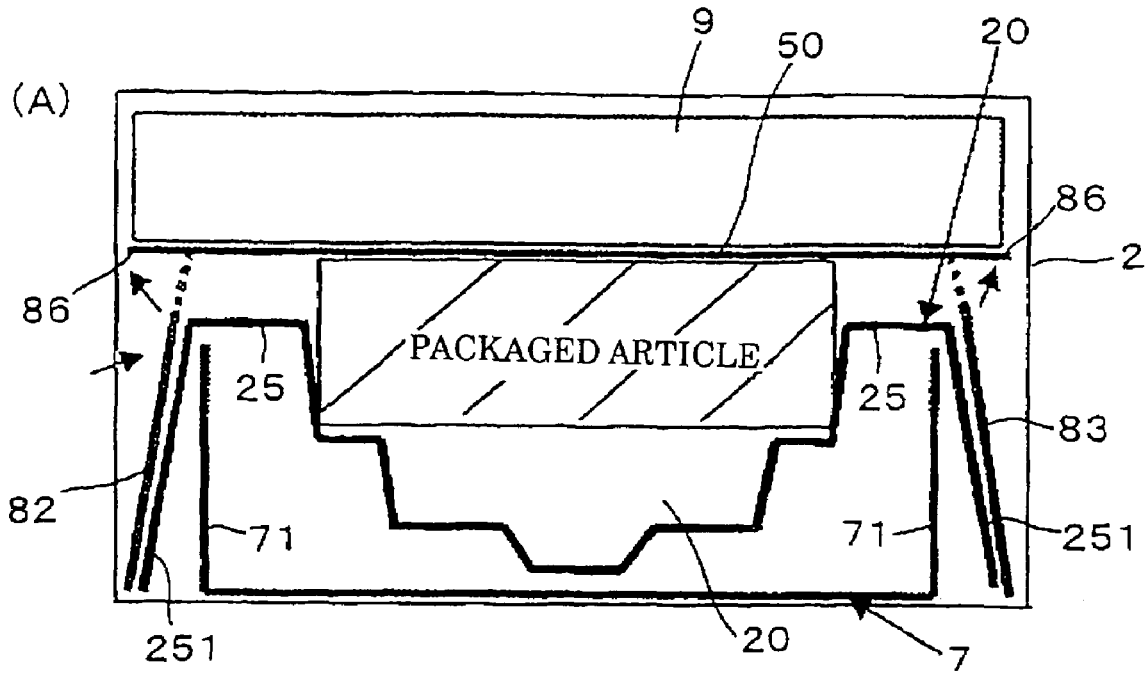
FIGS. 15A and 15B are a sectional view showing a mode of packaging a projector (electronic apparatus) as an article to be packaged into a corrugated cardboard box using a cushioning material for packaging according to Embodiment 8 of the invention and a perspective view showing an upper spacer used for the cushioning material for packaging, respectively.
Figure 15:
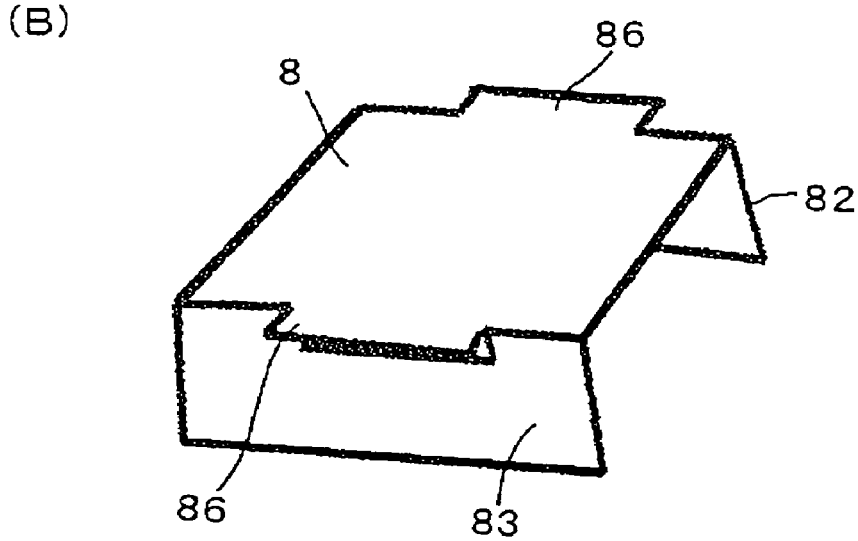

FIGS. 15A and 15B are an explanatory view showing a mode of packaging a projector (an electronic apparatus) as an article to be packaged in a corrugated cardboard box using a cushioning material for packaging according to Embodiment 8 of the invention and a perspective view showing an upper spacer used for the cushioning material for packaging.

In FIG. 15A, the article that is to be packaged using the cushioning material 1 for packaging according to this embodiment is a projector (or an optical engine mounted in the projector) 50. To package such a projector 50 in the corrugated cardboard box 2 (a discrete box), in this embodiment, the lower spacer 7 formed of corrugated cardboard, the lower pad 20 formed of sheet-like plastic foam, the projector 50, the upper spacer 8 formed of corrugated cardboard and the accessory accommodation box 9 are put one over another in the foregoing order, inside the corrugated cardboard box 2.

A plurality of lower-pad-side hollow convex portions 25 of the lower pad 20 protrude in such a fashion as to encompass the accommodation space 21 of the projector 50. Therefore, the lower-pad-side hollow convex portions 25 encompass the projector 50 between the lower pad 20 and the upper spacer 8.

In contrast, the upper spacer 8 is provided on the side of its opposing major sides with two upper side reinforcing plate portions 82 and 83 that are bent along the sidewall portions 251 at positions more outward than the sidewall portions 250 of the lower pad 20. The lower end portions of these upper side reinforcing plate portions 82 and 83 substantially reach the bottom of the corrugated cardboard box 2.

In the upper spacer 8, the upper side reinforcing sheet plates 82 and 83 are bent downward with a part of each of them being left uncut. The uncut portions 86 extend sideways as such and butt against the side surfaces of the corrugated cardboard box 2. Therefore, the cushioning material of this embodiment has the advantage that it has high impact resistance from the side directions.

Figure 16:
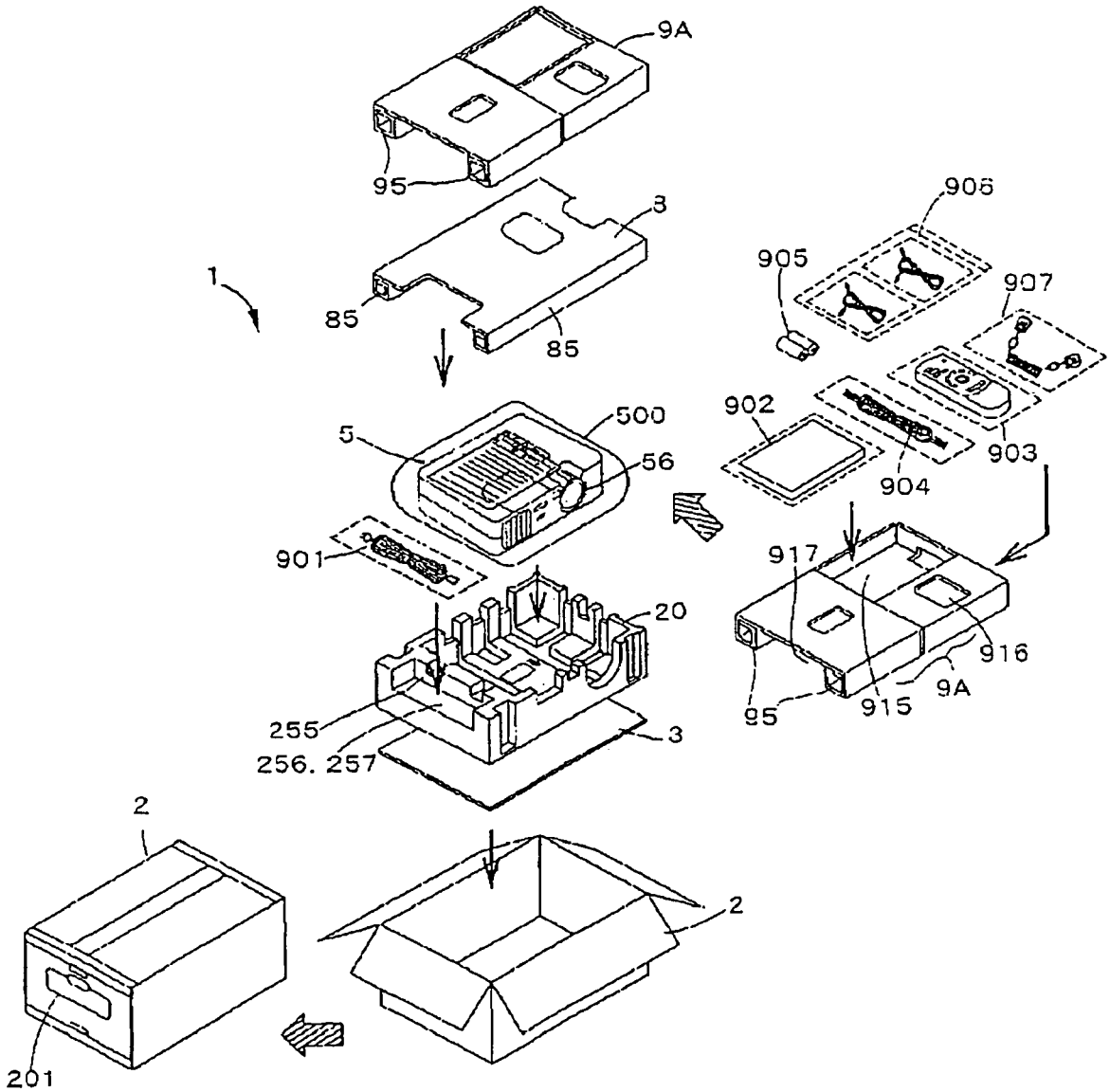
FIG. 16 is an explanatory view showing a mode of packaging a projector into a corrugated cardboard box using a cushioning material for packaging according to Embodiment 9 of the invention.
Figure 17:
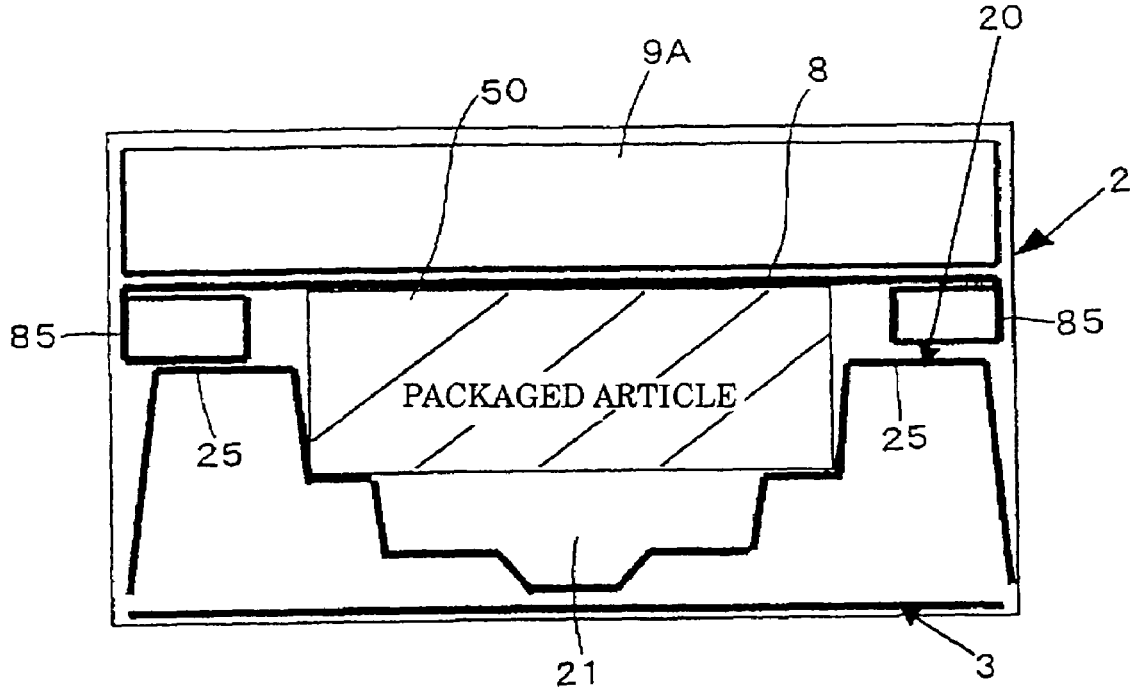
FIG. 17 is a sectional view schematically showing a condition where the corrugated cardboard box packaged as shown in FIG. 16 is cut in a minor side direction.
Figure 18:
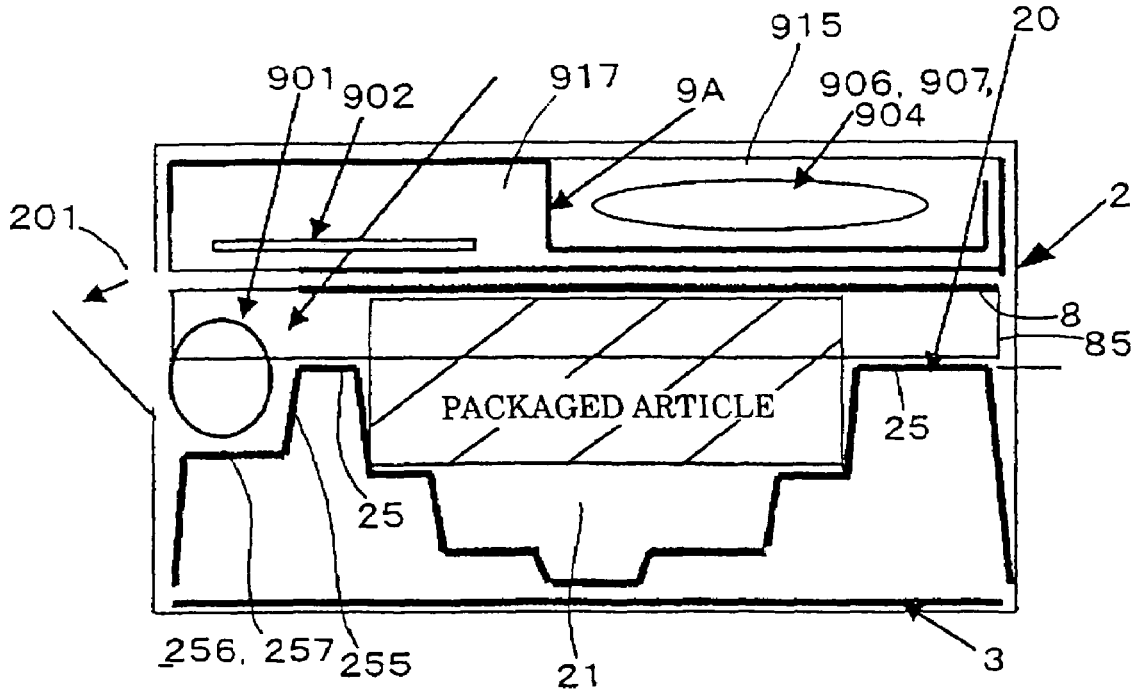
FIG. 18 is a sectional view schematically showing a condition where the corrugated cardboard box packaged as shown in FIG. 16 is cut in a major side direction.

FIGS. 16, 17 and 18 are respectively an explanatory view showing a mode of packaging a projector (an electronic apparatus) as an article to be packaged in a corrugated cardboard box using a cushioning material for packaging according to Embodiment 7 of the invention, a sectional view schematically showing a condition where the corrugated cardboard box packaging the projector is cut in a minor side direction, and a sectional view schematically showing a condition where the corrugated cardboard box packaging the projector is cut in a major side direction.

In FIGS. 16, 17 and 18, an article that is to be packaged using the cushioning material 1 for packaging according to this embodiment is a projector (or an optical engine mounted in the projector) 50, wherein a projection lens 56 protrudes from front surface of the projector 50.

To package such a projector 50 in the corrugated cardboard box 2 (a discrete box), in this embodiment, the lower stiffening plate 3 formed of corrugated cardboard, the lower pad 20, the projector 50 as the article to be packaged that is wrapped in an anti-static bag 500 having electrical conductivity, the upper spacer 8 formed of corrugated cardboard and an accessory accommodation tray 9A are put one over another in the foregoing order inside the corrugated cardboard box 2.

Here, the accessory accommodation tray 9 is provided on its opposing major sides with prismatic hollow portions 95. A remote controller 903, an AV cable 904, a cell 905, a mouse cable set 906 and a computer cable 907 among various accessories are accommodated in a recess portion 915 and spaces 916 and 917 defined between the pair of hollow portions 95.

A plurality of lower pad side hollow convex portions 25 of the lower pad 20 protrude in such a fashion as to encompass the accommodation space 21 of the projector 50. Therefore, the lower-pad-side hollow convex portions 25 encompass the projector 50 between the lower pad 20 and the upper spacer 8, and protect the projector from vibration during transportation. A molding produced from sheet-like plastic foam having a thickness of 3 mm and produced from recycled PET can be used for the lower pad 20, but a molding from a pulp mold is used in this embodiment.

The upper spacer 8 is provided on its opposing major sides with prismatic hollow portions 85 sandwiched between the accessory accommodation tray 9A and the lower side hollow convex portions 25.

When packaged using the cushioning material 1 for packaging having the construction described above, the projector 50 is accommodated between the upper spacer 8 and the lower pad 20. In this condition, the upper part of the upper spacer 8 keeps contact with the lower surface of the accessory accommodation tray 9, and the prismatic hollow portions 85 of the upper spacer 8 are interposed between the accessory accommodation tray 9A and the lower pad side hollow convex portions 25 of the lower pad 20. Therefore, the respective hollow portions 85 can accommodate a taller projector 50. In such a case, the projector 50 is protected between the upper spacer 8 and the lower pad 20 from the vertical direction and the side surface direction, and the impact will not be directly applied to the projector 50.

In this embodiment, the sidewall portion 255 of the lower pad 20 is recessed inward, and a step portion 257 capable of accommodating the accessory is formed in this recess portion 256. A window 201 for inserting a power source cable 901 is formed in the side surface of the corrugated cardboard box 2 in such a fashion as to correspond to the recess portion 256. Therefore, the power source cable 901 can be easily put even after the projector 50 is completely packaged in the corrugated cardboard box 2 using the cushioning material 1 for packaging.

Figure 19:
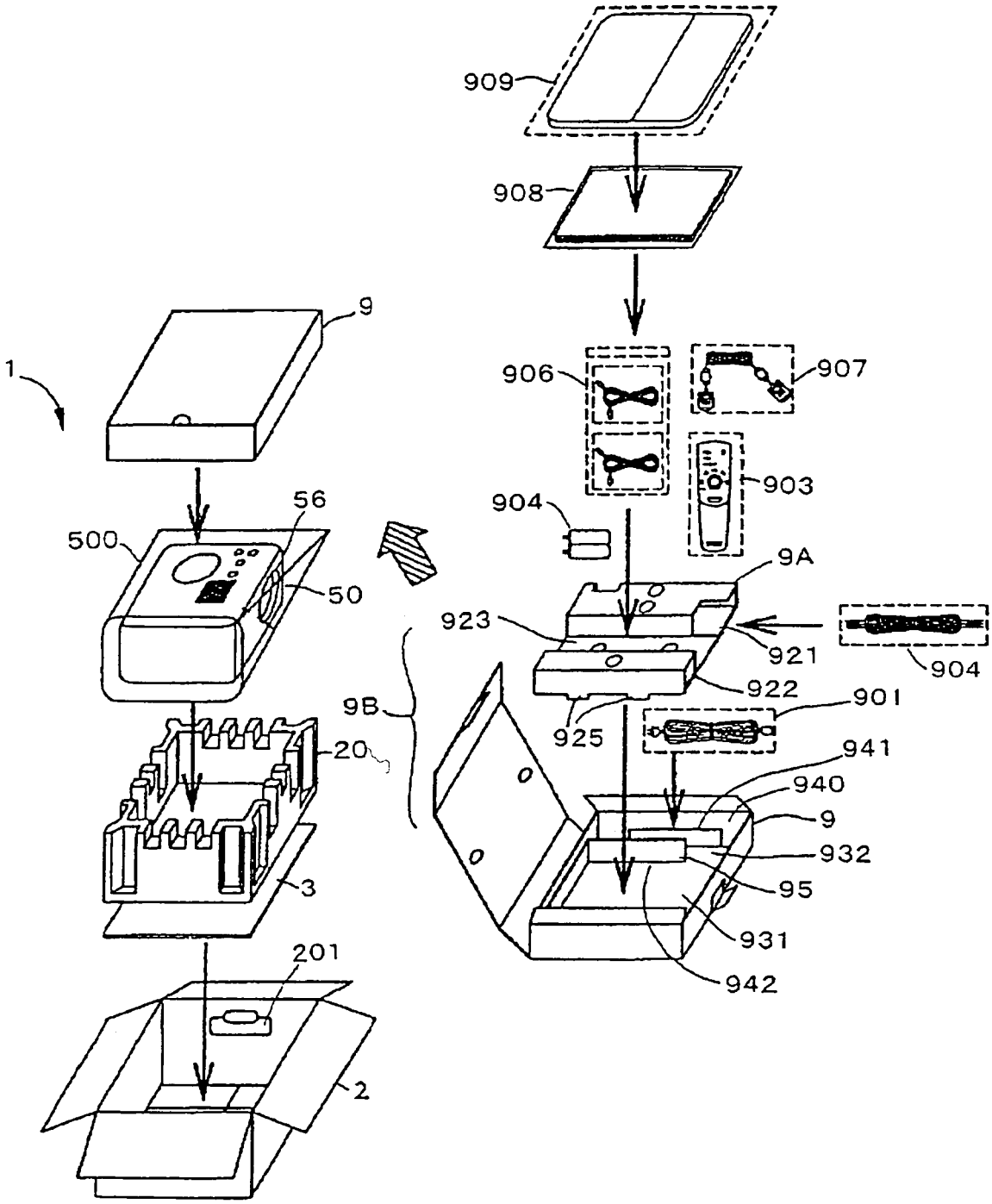
FIG. 19 is an explanatory view showing a mode of packaging a projector into a corrugated cardboard box using a cushioning material for packaging according to Embodiment 10 of the invention.
Figure 20:
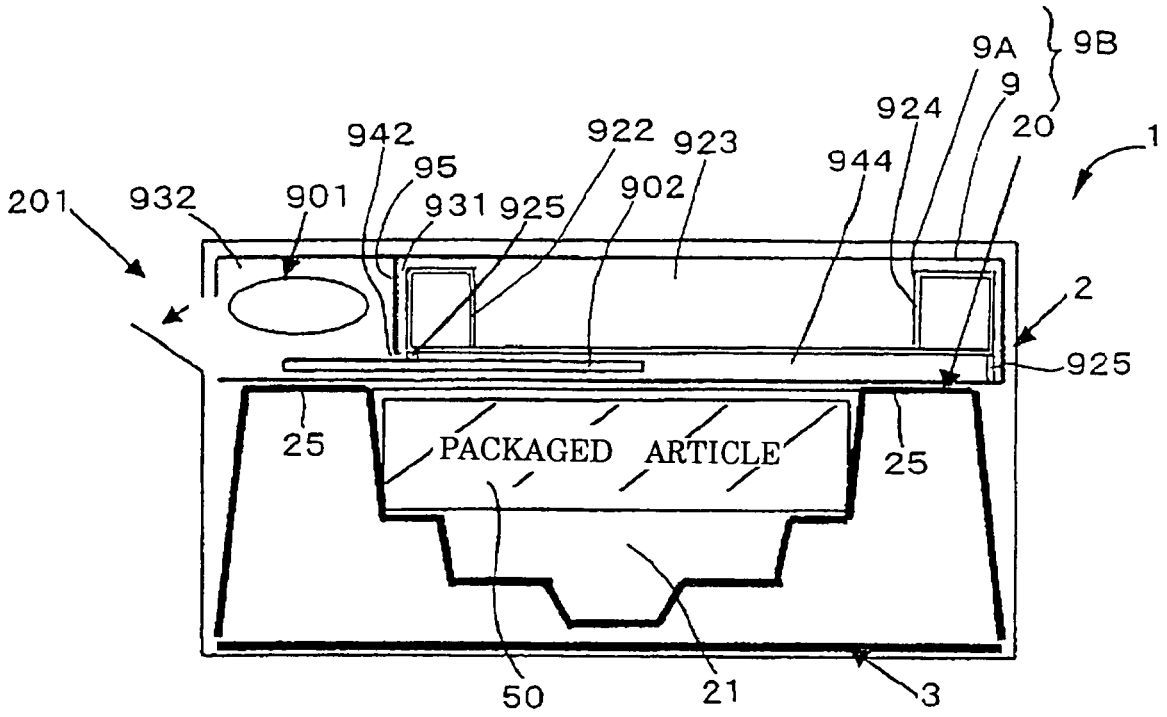
FIG. 20 is a sectional view schematically showing a condition where the corrugated cardboard box packaged as shown in FIG. 19 is cut in a minor side direction.
Figure 21:
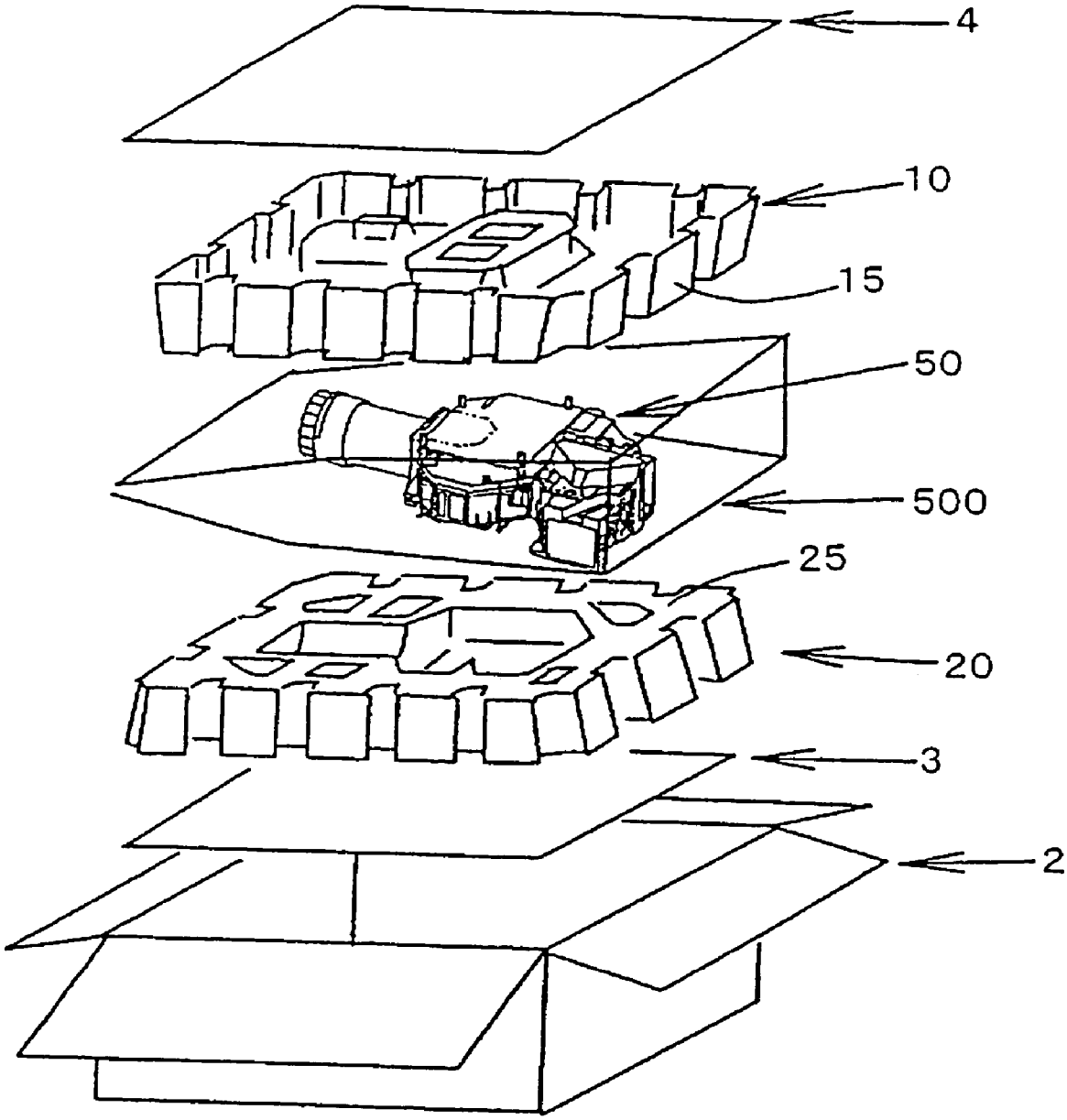
FIG. 21 is an explanatory view showing a mode of packaging a projector into a corrugated cardboard box using a cushioning material for packaging according to the prior art.
Figure 22:
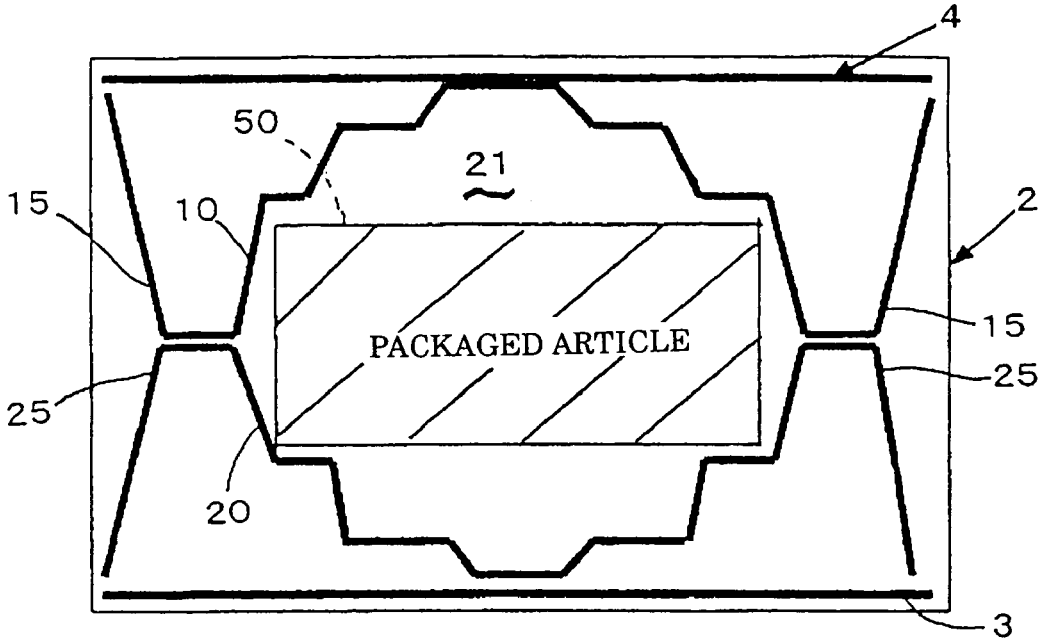
FIG. 22 is a sectional view schematically showing a condition where the corrugated cardboard box packaged as shown in FIG. 21 is cut.
Figure 23:
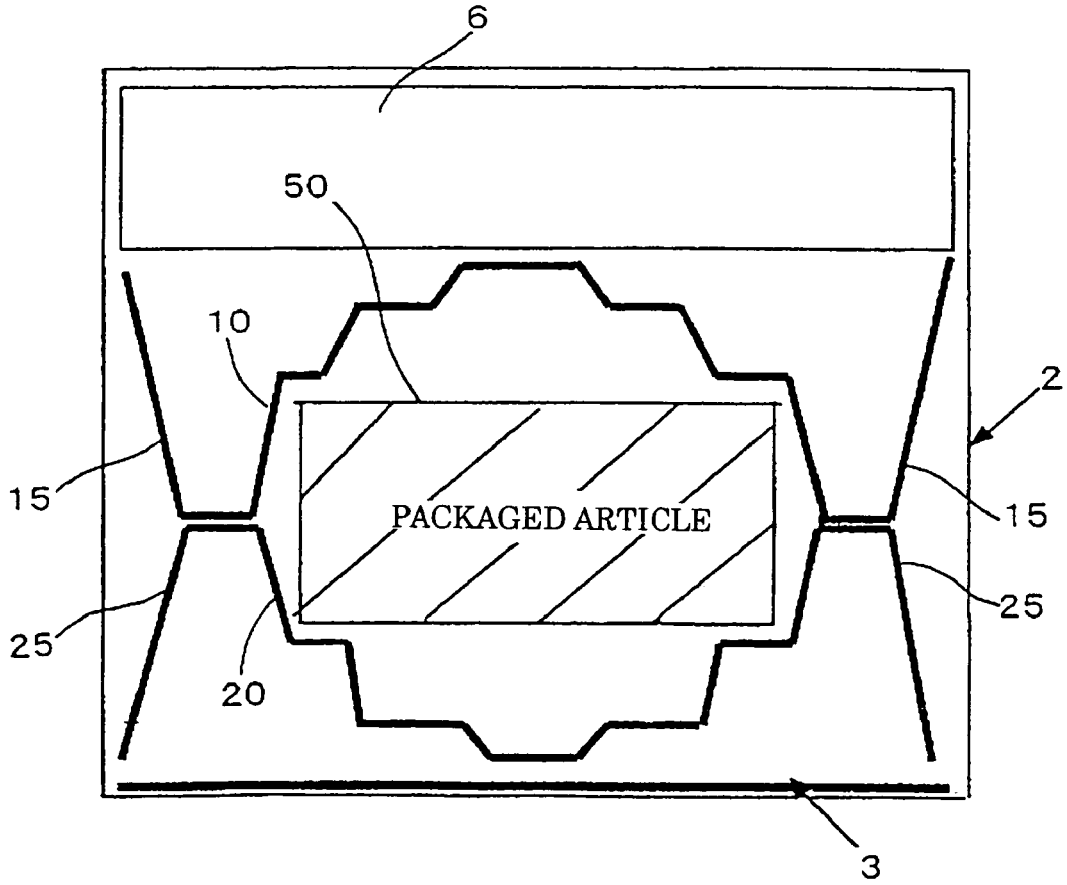
FIG. 23 is an explanatory view showing a mode of packaging a projector into a corrugated cardboard box using another cushioning material for packaging according to the prior art.
Figure 24:
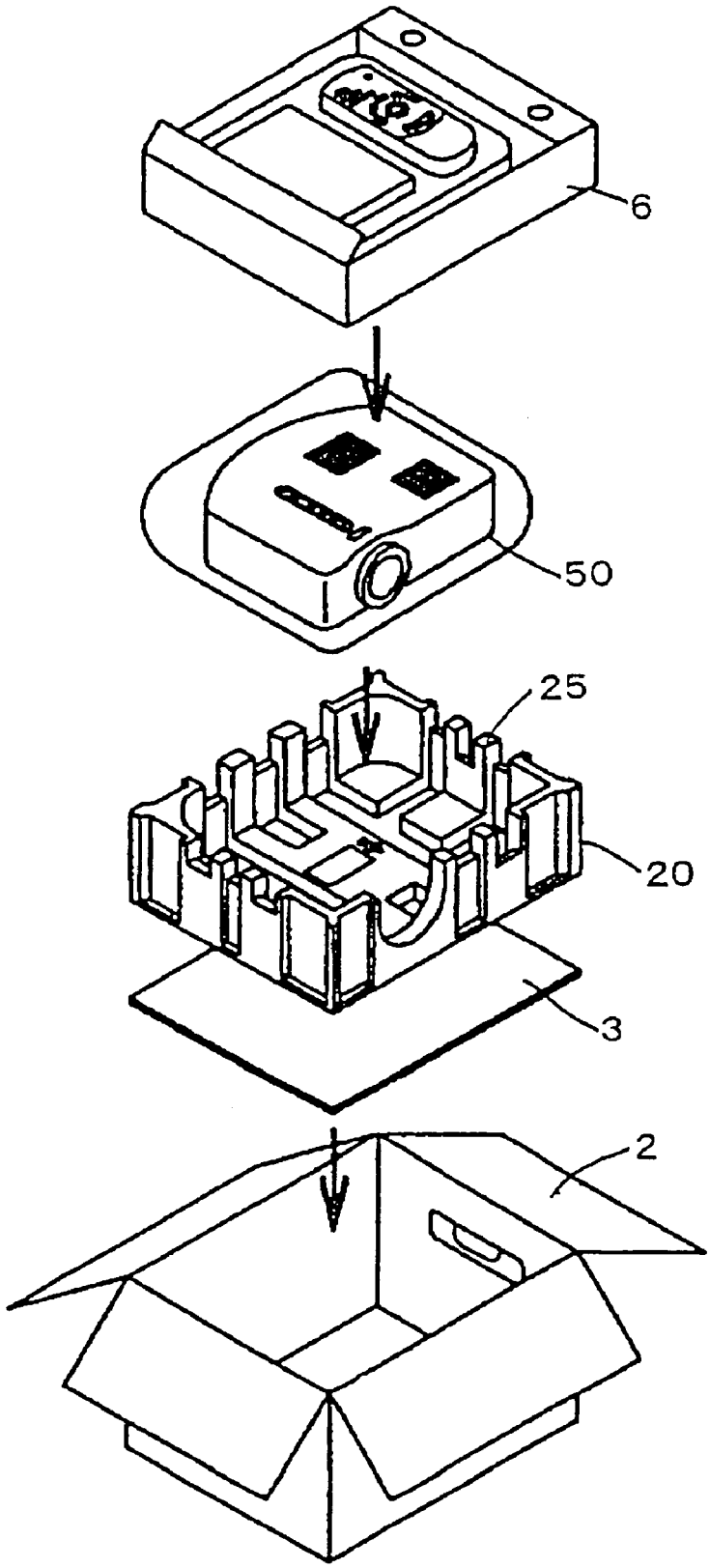
FIG. 24 is an explanatory view showing a mode of packaging a projector into a corrugated cardboard box using still another cushioning material for packaging according to the prior art.
Figure 25:
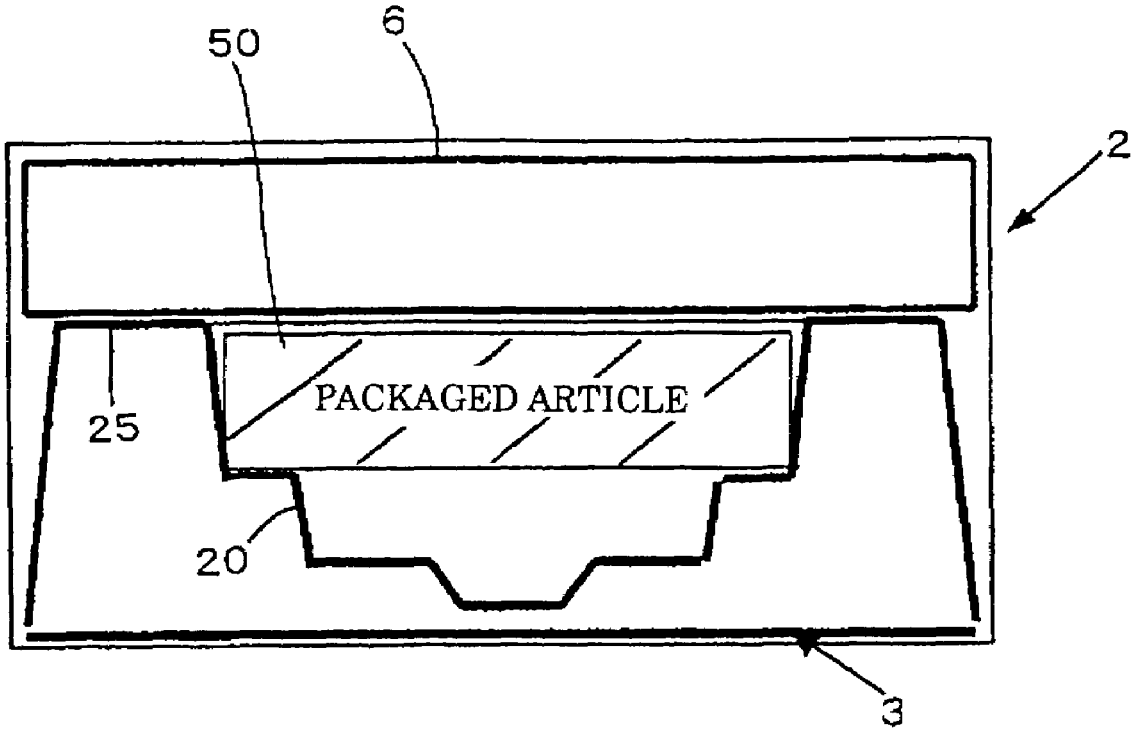
FIG. 25 is a sectional view schematically showing a condition where the corrugated cardboard box packaged as shown in FIG. 24 is cut.

FIGS. 19, 20 and 21 are respectively an explanatory view showing a mode of packaging a projector (an electronic apparatus) as an article to be packaged in a corrugated cardboard box using a cushioning material for packaging according to Embodiment 8 of the invention, a sectional view schematically showing a condition where the corrugated cardboard box packaging the projector is cut in a minor side direction, and a sectional view schematically showing a condition where the corrugated cardboard box packaging the projector is cut in a major side direction.

In FIGS. 19 and 20, the article that is to be packaged using the cushioning material 1 for packaging according to this embodiment is a projector (or an optical engine mounted in the projector) 50, wherein a projection lens 56 protrudes from a front surface of the projector 50.

To package such a projector 50 in the corrugated cardboard box 2 (a discrete box), in this embodiment, a lower stiffening plate 3 of corrugated cardboard, a lower pad 20, the projector 50 as the article to be packaged that is wrapped in an anti-static bag 500 having electrical conductivity, and an accessory accommodation box 9 are put one over another in the foregoing order inside the corrugated cardboard box 2.

A plurality of lower pad side hollow convex portions 25 of the lower pad 20 protrude in such a fashion as to encompass the accommodation space 21 of the projector 50. Therefore, the lower pad side hollow convex portions 25 encompass the projector 50 between the lower pad 20 and the accessory accommodation box 9, and protect the projector 50 from vibration during transportation. A molding produced from sheet-like plastic foam having a thickness of 3 mm and produced from recycled PET can be used for the lower pad 20, but a molding from a pulp mold is used in this embodiment.

To accommodate various accessories, an accessory accommodation body 9B comprising the accessory accommodation box 9 formed of corrugated cardboard and the accessory accommodation tray 9A formed of corrugated cardboard for accommodating various accessories at respective positions inside the accessory accommodation box 9 is used in this embodiment.

The accessory accommodation tray 9A is provided on its both sides with prismatic hollow portions 921 and 922. A portion interposed between these hollow portions 921 and 922 is a recess portion 923. A remote controller 903, an AV cable 904, a cell 905, a mouse cable set 906, a computer cable 907, an instruction manual 908 and a soft case 909 can be accommodated at predetermined positions on the accessory accommodation tray 9A.

A flap-like partition 95 is formed inside the accessory accommodation box 9 and partitions the inside of the accessory accommodation box 9 into two spaces 931 and 932. Therefore, the accessory accommodation tray 9A can be accommodated in the space 931 and the power source cable 901 in the space 932.

A drop slot 941 is formed in a lower half portion of the side surface 940 facing the space 932 among the side surfaces of the accessory accommodation box 9. Although the partition 95 partitions the inside of the accessory accommodation box 9 into the two spaces 931 and 932, the partition 95 is formed into a belt shape having a width that is less than the inner height of the accessory accommodation box 9. Therefore, a gap 942 is formed between the partition 95 and the bottom of the accessory accommodation box 9. Since the partition 95 is only fixed at its proximal end into the side surface of the accessory accommodation box 9, the portion partitioning the spaces 931 and 932 is movable. Furthermore, a protrusion 925 is so formed in the accessory accommodation tray 9A as to protrude downward from its bottom surface. Therefore, another gap 944 (see FIG. 20) is formed between the bottom surface of the accessory accommodation tray 9A and the bottom surface of the accessory accommodation box 9 when the accessory accommodation tray 9A is accommodated in the accessory accommodation box 9.

When the projector 50 is packaged in the corrugated cardboard box 2 using the cushioning material 1 for packaging that has the construction described above, the projector 50 is accommodated between the lower pad 20 and the accessory accommodation body 9B (the accessory accommodation box 9). In such conditions, the lower pad side hollow convex portions 25 of the lower pad 20 and the buffer function of the accessory accommodation box 9 work to protect the projector 50. Even if an impact is applied from the vertical direction and the side surface direction, therefore, the impact will not be directly transmitted to the projector 50.

In this embodiment, a window 201 is formed on the side surface of the corrugated cardboard box 2 at a position corresponding to the drop slot 941 formed in the accessory accommodation box 9 when the accessory accommodation box 9 is accommodated in the corrugated cardboard box 2.

Moreover, the gap 942 is defined between the partition and the bottom of the accessory accommodation box 9 inside the accessory accommodation box 9, and the gap 944 is also formed between the bottom surface of the accessory accommodation tray 9A and the bottom of the accessory accommodation box 9. Therefore, even after the projector 50 and the accessory accommodation box 9 are completely packaged in the corrugated cardboard box 2, an additional instruction manual translated into a specific language can be inserted into the drop slot 941 through the window 201. The instruction manual 902 so inserted can slide into the gap 944 between the bottom surface of the accessory accommodation tray 9A and the bottom of the accessory accommodation box 9 through the gap 942 formed between the partition 95 and the bottom of the accessory accommodation box 9.

The partition 95 partitions the accessory accommodation box 9 into the two spaces 931 and 932. Since the gap 942 is defined between the partition 95 and the bottom of the accessory accommodation box 9, however, the instruction manual 902 can be accommodated across the spaces 931 and 932. Therefore, an instruction manual 902 having a size greater than the individual spaces 931 and 932 can be easily accommodated.

The construction explained in each of the embodiments described above may be combined with others. For example, the flat sheet-like stiffening plate 3 is used in Embodiments 9 and 10 but the lower spacer 7 explained in Embodiment 1 may also be used.

When the lower stiffening plate 3 is used, an opening may be formed at a portion overlapping plane-wise the projector accommodation portion as explained in Embodiment 1.

The foregoing Embodiments have been explained about the projector as the article to be packaged, but it should be understood that the invention may also be applied to packaging of other electronic apparatus and optical apparatus.

The invention claimed is:

1. A cushioning material for packaging, comprising:

an upper pad and a lower pad, each having upper pad side hollow convex portions and lower-pad-side hollow convex portions protruding such as to encompass an accommodation space for an article to be packaged, said cushioning material further comprising an upper spacer having upper side solid reinforcing plate portions that enter substantially completely into said upper pad side hollow convex portions when said upper spacer is disposed over said upper pad.

2. A cushioning material for packaging, comprising:

an upper pad and a lower pad, each having upper-pad-side hollow convex portions and lower-pad-side hollow convex portions protruding such as to encompass an accommodation space for an article to be packaged, said cushioning material further comprising a lower spacer having lower side solid reinforcing plate portions that enter—substantially completely into said lower-pad-side hollow convex portions when said lower spacer is disposed under said lower pad.

3. A cushioning material for packaging, comprising:

an upper pad and a lower pad, each having upper-pad-side hollow convex portions and lower-pad-side hollow convex portions protruding such as to encompass an accommodation space for an article to be packaged, said cushioning material further comprising a lower spacer having lower side solid reinforcing plate portions that enter deep into said lower-pad-side hollow convex portions when said lower spacer is disposed under said lower pad, and an upper spacer having upper side reinforcing plate portions that enter deep into said upper-pad-side hollow convex portions when said upper spacer is disposed over said upper pad.

4. A cushioning material for packaging according to claim 1, both of said upper pad and said lower pad being formed of sheet-like plastic foam.

5. A cushioning material for packaging according to claim 1, both of said upper pad and said lower pad being formed of pulp mold.

6. A cushioning material for packaging according to claim 1, said lower pad having a flange portion that extends from a lower edge of a sidewall portion positioned on an outer peripheral side, said flange portion being folded back inside said sidewall portion to double said sidewall portion, thereby forming a sidewall reinforcing portion.

7. A cushioning material for packaging according to claim 6, reinforcing ribs being formed on said flange portion.

8. A package according to claim 1, an article to be packaged being at least one of an electronic apparatus, an electronic apparatus having an optical system mounted therein and an optical apparatus.

9. A package obtained by packaging an article to be packaged in a corrugated cardboard box using said cushioning material for packaging according to claim 1.

* * * * *

UNITED STATES PATENT AND TRADEMARK OFFICE

CERTIFICATE OF CORRECTION

PATENT NO. : 7,328,800 B2
APPLICATION NO. : 10/476285
DATED : February 12, 2008
INVENTOR(S) : Motomu Koike It is certified that error appears in the above-identified patent and that said Letters Patent is hereby corrected as shown below:

Title page, item [54] and Col. 1, change "CUSHIONING MATERIAL FOR PACKAGING AND PACKAGING MATTER" to --CUSHIONING MATERIAL FOR PACKAGING AND PACKAGE--

Col. 20, claim 2, lines 7-8 change "spacer having lower side solid reinforcing plate portions that enter-substantially completely into said" to --spacer having lower side solid reinforcing plate portions that enter substantially completely into said--

Signed and Sealed this

Seventeenth Day of June, 2008

JON W. DUDAS
*Director of the United States Patent and Trademark Office*